US007857734B2

(12) United States Patent
Miller et al.

(10) Patent No.: US 7,857,734 B2
(45) Date of Patent: Dec. 28, 2010

(54) SPORTS TRAINING SYSTEM

(75) Inventors: Larry S. Miller, Carencro, LA (US); Daniel P. Daigle, Baton Rouge, LA (US); Gregory K. Picou, Gulfport, MS (US)

(73) Assignee: Glideboxx, L.L.C., Carencro, LA (US)

( * ) Notice: Subject to any disclaimer, the term of this patent is extended or adjusted under 35 U.S.C. 154(b) by 1282 days.

(21) Appl. No.: 11/071,583

(22) Filed: Mar. 4, 2005

(65) Prior Publication Data

US 2006/0058164 A1 Mar. 16, 2006

Related U.S. Application Data

(60) Provisional application No. 60/609,262, filed on Sep. 14, 2004.

(51) Int. Cl.
*A63B 21/00* (2006.01)

(52) U.S. Cl. ..... 482/83; 482/87; 212/285; 212/270

(58) Field of Classification Search ..... 482/83–90, 482/140; 248/106; 348/373, 69; 212/285, 212/270

See application file for complete search history.

(56) References Cited

U.S. PATENT DOCUMENTS

| | | | | | |
|---|---|---|---|---|---|
| 743,914 | A * | 11/1903 | McMurran | 248/106 |
| 2,713,609 | A * | 7/1955 | Niklason | 348/373 |
| 3,424,458 | A * | 1/1969 | Hopps, Jr. | 473/443 |
| 3,547,438 | A | 12/1970 | Schmitter | |
| 3,556,523 | A * | 1/1971 | Hooker | 473/443 |
| 3,637,210 | A * | 1/1972 | Brantley | 473/443 |
| 4,795,149 | A * | 1/1989 | Pearson | 482/98 |
| 5,224,912 | A * | 7/1993 | Moody | 482/87 |
| 5,417,630 | A * | 5/1995 | Schultz | 482/70 |
| 5,669,859 | A * | 9/1997 | Liggett et al. | 482/94 |
| 5,897,466 | A * | 4/1999 | Capach | 482/83 |
| 6,220,992 | B1 | 4/2001 | Shafik | |
| 6,244,991 | B1 * | 6/2001 | Bingham | 482/69 |

(Continued)

FOREIGN PATENT DOCUMENTS

DE 463046 C 7/1928

(Continued)

OTHER PUBLICATIONS

Search report and written opinion issued by US as search authority in PCT/US 05/32704.

*Primary Examiner*—Jerome Donnelly
(74) *Attorney, Agent, or Firm*—Jones, Walker, Waechter, Poitevent, Carrere & Denegre, LLP

(57) ABSTRACT

A sports training system includes a supporting structure, a first moving element supported by the supporting structure so as to be moveable relative to the supporting structure along a first path, a second moving element supported by the first moving element so as to be moveable relative to the first moving element along a second path different from the first path, and a punching bag suspended below the first moving element by the second moving element. The punching bag is moveable to any point within an area defined by the first and second paths when a trainee strikes the punching bag, thereby mimicking movements of an opponent. One or more elastic elements can be attached between the punching bag and the supporting structure for returning the punching bag to a desired region within the area.

11 Claims, 26 Drawing Sheets

U.S. PATENT DOCUMENTS

| | | | | |
|---|---|---|---|---|
| 6,530,867 | B2 | 3/2003 | Schwendemann | |
| 6,758,794 | B2 | 7/2004 | Lee | |
| 7,063,651 | B2 * | 6/2006 | Kerry | 482/140 |
| 7,121,989 | B2 * | 10/2006 | Kerry | 482/140 |

FOREIGN PATENT DOCUMENTS

| | | | |
|---|---|---|---|
| SU | 1694170 | A2 | 11/1991 |

* cited by examiner 302
409

303
402

509
509
503

505
533

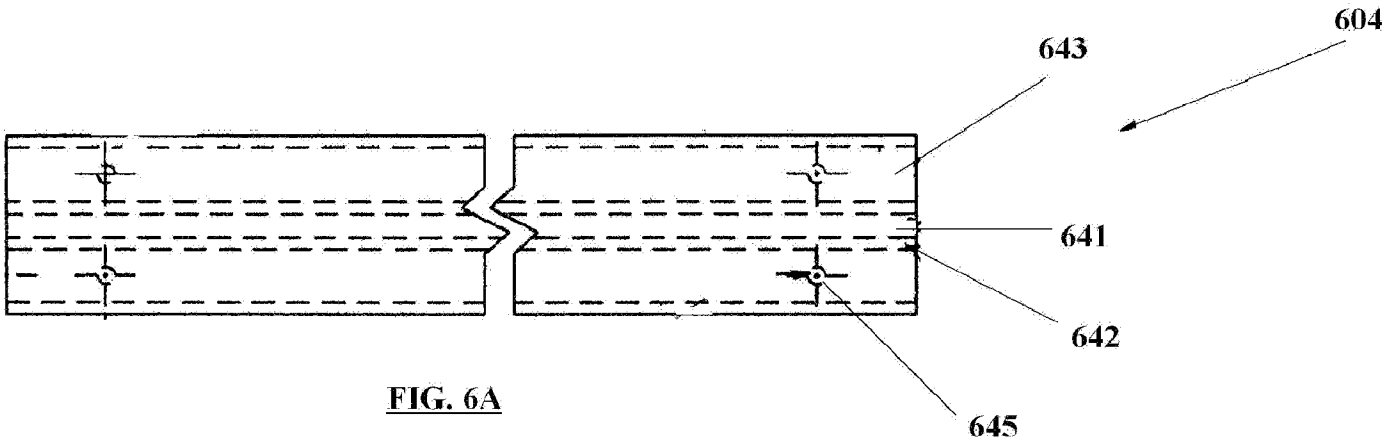
FIG. 6A
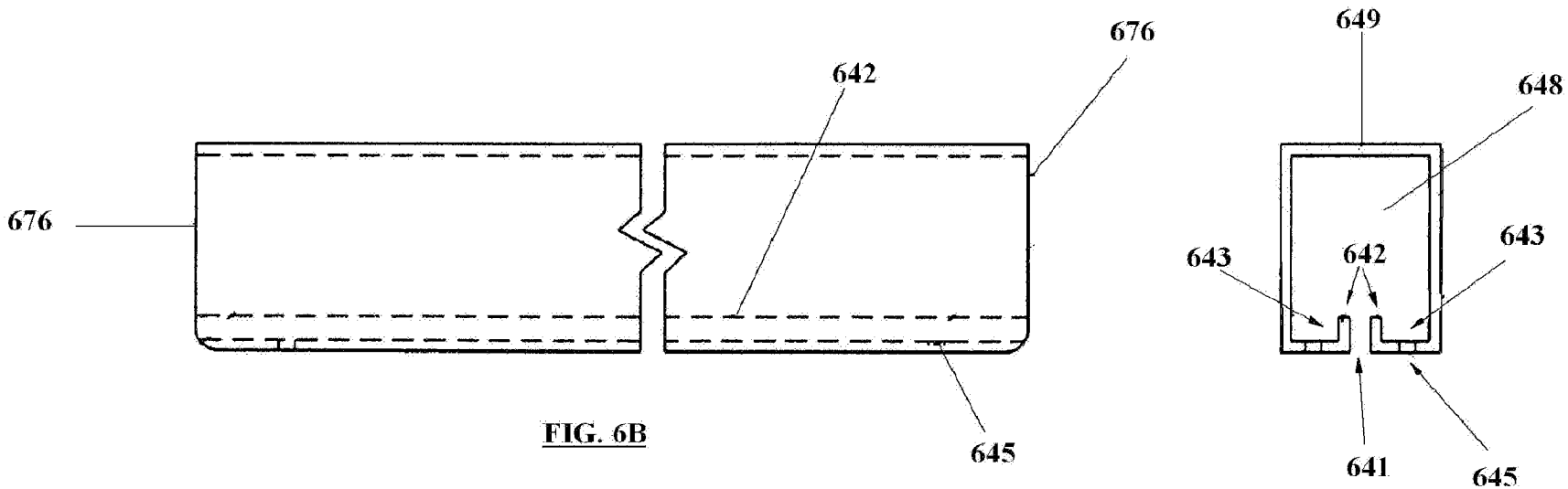
FIG. 6B
FIG. 6C 828
826
827
828

821
822
824

821
822

821

1160
1164
1171
1172
1173
643

708
1163
1164
757

699
1161
1162
1171
1172
1173
1161
1162

SPORTS TRAINING SYSTEM

RELATED APPLICATIONS

This application is based on and claims the benefit of U.S. Provisional Application No. 60/609,262, filed Sep. 14, 2004, the disclosure of which is incorporated herein in its entirety.

TECHNICAL FIELD

The present invention generally relates to sports training systems, and more particularly, to a punching bag suspending apparatus that allows the bag to move when it is struck by a user, thereby mimicking the movement of an opponent.

BACKGROUND ART

Devices for supporting or suspending punching bags are known in the art. Athletes practicing boxing, kick-boxing, karate, marshal arts, self defense skills and other strike related techniques generally use punching bags for training. In a typical punching bag suspending or supporting device, the punching bag is supported from the floor and/or suspended from a ceiling. Such a typical, conventional device holds the bag at a predetermined, stationary location and allows it to only move around and finally return to the stationary location in substantially the same trajectory. The movement and returned position of the bag is, therefore, quite limited, unrealistic and easily predictable. As a result, the conventional devices do not provide athletes with a "real combat" experience where opponents constantly move during the fight, rather than staying at the same spot.

Therefore, there is a need for a sports training system which can enhance a person's boxing, fighting, or self defense skills by allowing a punching bag to move and return in response to the person's strikes with unpredictability, thereby mimicking the movement of a real opponent.

SUMMARY OF THE INVENTION

It is, therefore, an object of the present invention to allow a suspended weight or punching bag to move within predetermined boundaries in response to a user's strike(s), thereby mimicking the movement of an opponent.

The above and other objects of the present invention are achieved by a sports training system, comprising: a supporting structure; a first moving element supported by the supporting structure so as to be moveable relative to the supporting structure along a first path; and a second moving element supported by the first moving element so as to be moveable relative to the first moving element along a second path different from the first path; the second moving element comprising an attaching member for suspending a weight below the first moving element, thereby enabling the suspended weight to be moveable to any point within an area defined by the first and second paths.

In accordance with an aspect of the present invention, the supporting structure includes two spaced beams, and the first moving element includes a bar having opposite ends each being moveably supported by one of the beams of the supporting structure. In accordance with another aspect of the present invention, the relative movements between the first and second moving elements and the supporting structure can be of any types, such as, sliding, rolling or by gear. In accordance with a further aspect of the present invention, one or more elastic elements are provided to tie the second moving element or the suspended weight to one or more portions of the supporting structure for returning the suspended weight to a desired region within the area after the suspended weight has been moved outside the region by a user.

The objects of the present invention are further achieved by a sports training system, comprising: a suspended weight; first moveable means for suspending the suspended weight; second moveable means for moveably supporting the first moveable means on a first path; and supporting means for moveably supporting the second moveable means on a second path different from the first path, thereby enabling the suspended weight to be moveable to any point within an area defined by the first and second paths. Preferably, the system further comprises biasing means for biasing the second moving element, and hence the suspended weight, toward a predetermined region within the area after the suspended weight has been moved outside the predetermined region by a user.

The objects of the present invention are also achieved by a method of installing a sports training system, comprising: providing a supporting structure; positioning a first moving element on the supporting structure so that the first moving element is moveable relative to the supporting structure along a first path; attaching a second moving element to the first moving element so that the second moving element is moveable relative to the first moving element along a second path different from the first path; and suspending a punching bag below the first moving element by the second moving element, thereby enabling the punching bag to be moveable to any point within an area defined by the first and second paths when a user strikes the punching bag. Preferably, the method further comprises attaching the punching bag to a portion of the supporting structure with at least one elastic element which will bias the punching bag towards the portion of the supporting structure when the punching bag is struck by the user with a force sufficient to tension the at least one elastic element.

The objects of the present invention are further achieved by a sports training kit, comprising a punching bag suspension system and at least one elongated, elastic element, the punching bag suspension system comprising: a supporting structure; a first moving element supported by the supporting structure so as to be moveable relative to the supporting structure along a first path; and a second moving element supported by the first moving element so as to be moveable relative to the first moving element along a second path different from the first path, the second moving element comprising an attaching member for suspending a punching bag below the first moving element, thereby enabling the punching bag to be moveable to any point within an area defined by the first and second paths; wherein the elongated, elastic element is adapted to be attached between the supporting structure and the second moving element or the punching bag for biasing the punching bag towards a region inside the area after the punching bag has been moved by a user outside the region.

The objects of the present invention are still further achieved by a sports training system for enabling a user to exercise with a punching bag, the system comprising: a punching bag suspension device adapted for suspending the punching bag inside a predetermined area and being operable for enabling movement of the suspended punching bag from a first stationary position to a second, different stationary position within the predetermined area when the suspended punching bag is hit by the user.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout, and wherein:

FIGS. 6A-6C are respectively top, front and side views of a moveable bar to be used with the frame of FIG. 3;

FIG. 12 shows a pin used to fix the gear wheel of FIGS. 8A-8C to a rod as shown in FIGS. 11A-11B;

DETAILED DESCRIPTION OF PREFERRED EMBODIMENTS

Figure 1:
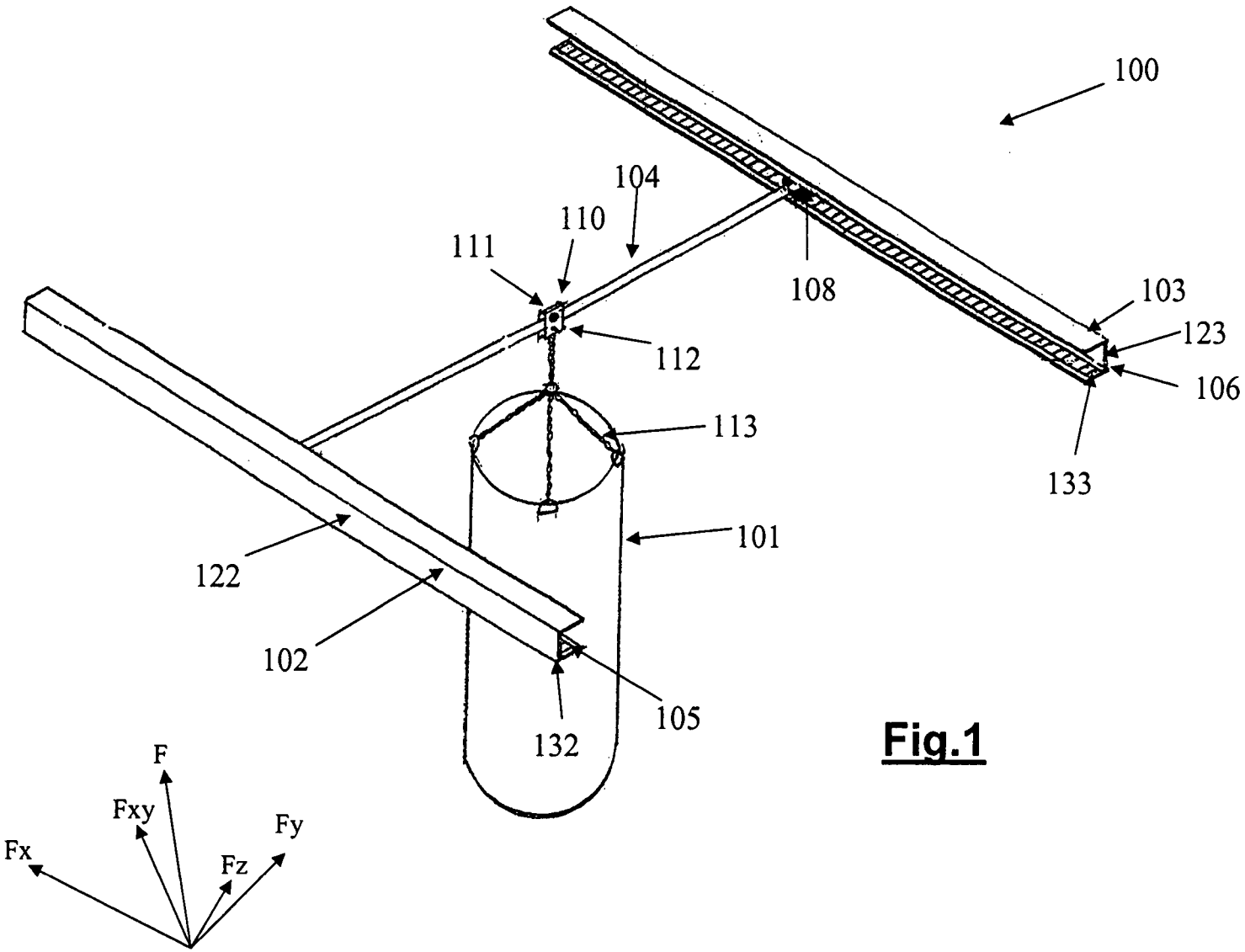
FIG. 1 is a perspective view of a sports training system in accordance with a first embodiment of the present invention.

A sports training system and a method of installing such a system in accordance with the present invention are described. In the following detailed description, for purposes of explanation, numerous specific details are set forth in order to provide a thorough understanding of the present invention. It will be apparent, however, that the present invention may be practiced without these specific details. In other instances, well-known structures and devices are schematically shown in order to simplify the drawing.

FIG. 1 is a perspective view of a sports training system 100 in accordance with a first embodiment of the present invention.

System 100 includes two inwardly facing metal (or other suitably hard material) "C" shaped channels 102, 103 of approximately 3.5 inches in height and six feet in length. The length and sizing of channels 102, 103 can be longer or shorter depending on the desired movements of a weight or punching bag 101 suspended below a bar 104 which is moveably supported at opposite end thereof by channels 102, 103. In a preferred configuration, two channels 102, 103 are spaced six feet apart, parallel, and with the "C" shape facing each other.

Inside each channel 102 or 103 there is a gear rack 105 or 106 that runs preferably the entire length of the channel. Again, gear racks 105, 106 and moveable bar 104 can be of any length depending on the desired movements of the suspended weight or punching bag 101. In a preferred configuration, moveable bar 104 is a six foot axle with gear wheels or pinions (only one of which is visible in FIG. 1 at 108) on either end of the axle. Axle 104 spans two channels 102, 103 and rides on gear racks 105, 106 to permit movement of punching bag 101 in a longitudinal direction of channels 102, 103. A stop pin (not shown) on all four ends of channels 102, 103 prevents axle 104 from moving outside channels 102, 103 and derailing from gear racks 105, 106.

Figures 8A, 8B, 8C, 8D:
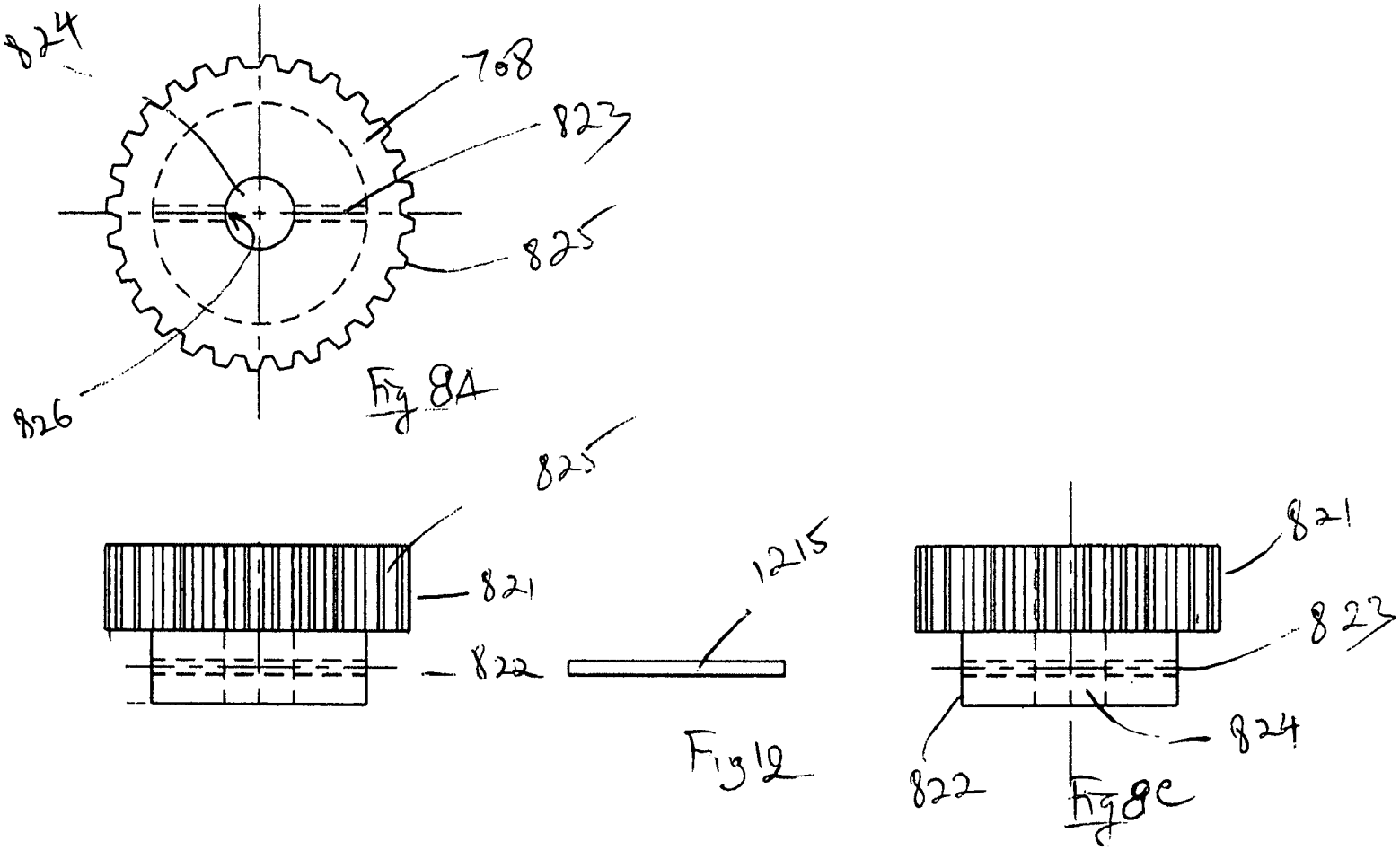
FIGS. 8A-8C are respectively top, front and side views of a gear wheel used to moveably support the moveable bar of FIGS. 6A-6C on the frame of FIG. 3 as shown FIG. 7.

Preferably, each gear wheel 108 is similar to gear wheel 708 depicted in FIGS. 8A-8C. Gear wheel 708 is preferably a spur gear with straight teeth although other types of gears are not excluded. Gear wheel 708 has a first section 821 which has a greater diameter and teeth 825 and a second section 822 which has a smaller diameter and no teeth. A through hole 823 extends diametrically through second section 822. Another through hole 824 extends axially through both first section 821 and second section 822. FIG. 12 shows a pin 1215 sized and shaped to be receivable in through hole 823 of second section 822. Through holes 823 and 824 are communicated with each other at 826, FIG. 8A. Through holes 823 is sized to receive an end of axle 104 which has a hole (not shown) alignable with hole 823 of gear wheel 708. Pin 1215 (FIG. 12) can be inserted into the hole at the end of axle 104 and hole 823 of gear wheel 708 to irrotationally lock gear wheel 708 to axle 104. In an alternative configuration, gear wheel 108 is different from gear wheel 708 in that second section 822 is omitted and axle 104 is directly attached to first section 821, e.g., by welding or construction adhesive.

Figure 10A:
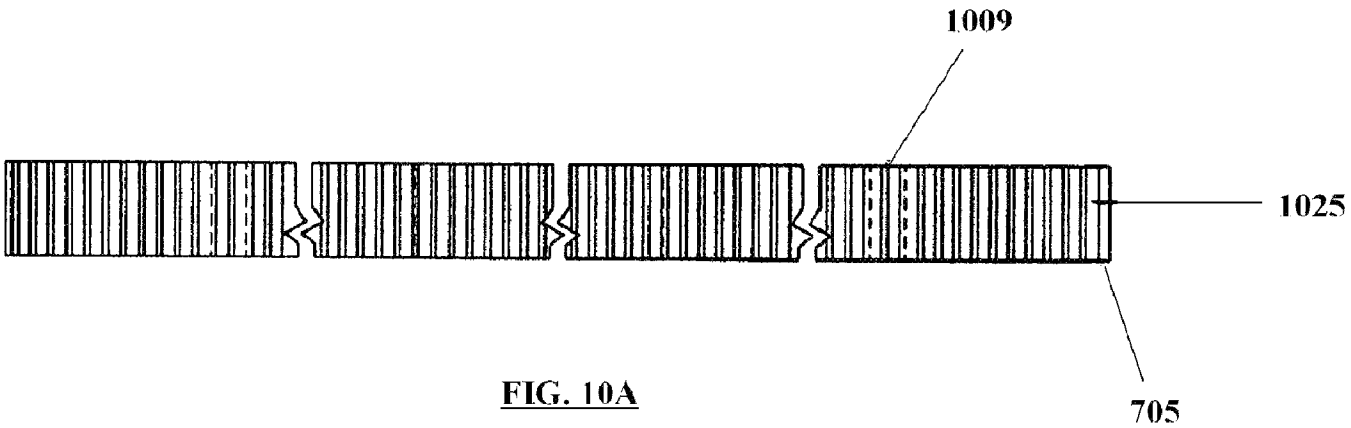
FIGS. 10A-10C are respectively top, front and side views of a rack on which the moveable bar of FIGS. 6A-6C are moveably supported as shown FIG. 7.
Figure 10B:
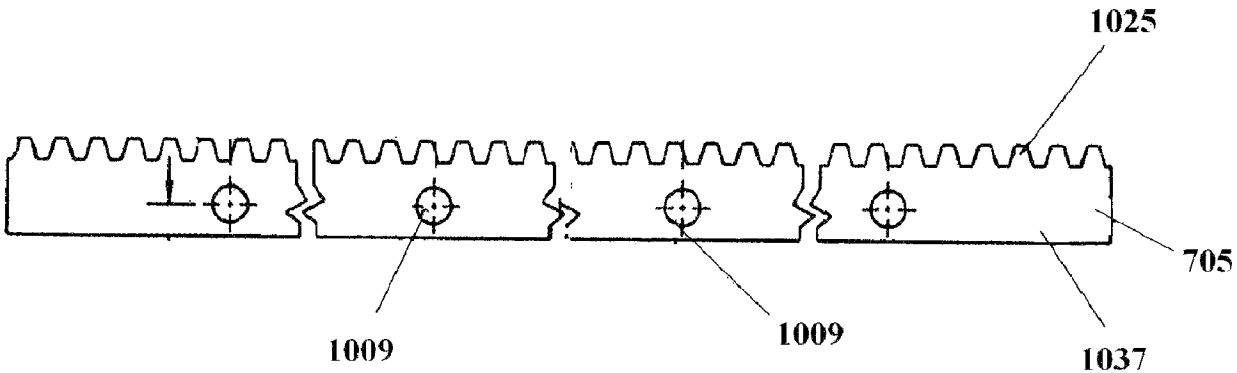
Figure 10C:
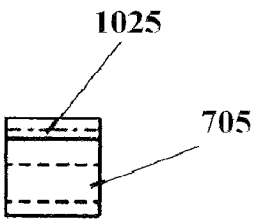
Figure 10D:
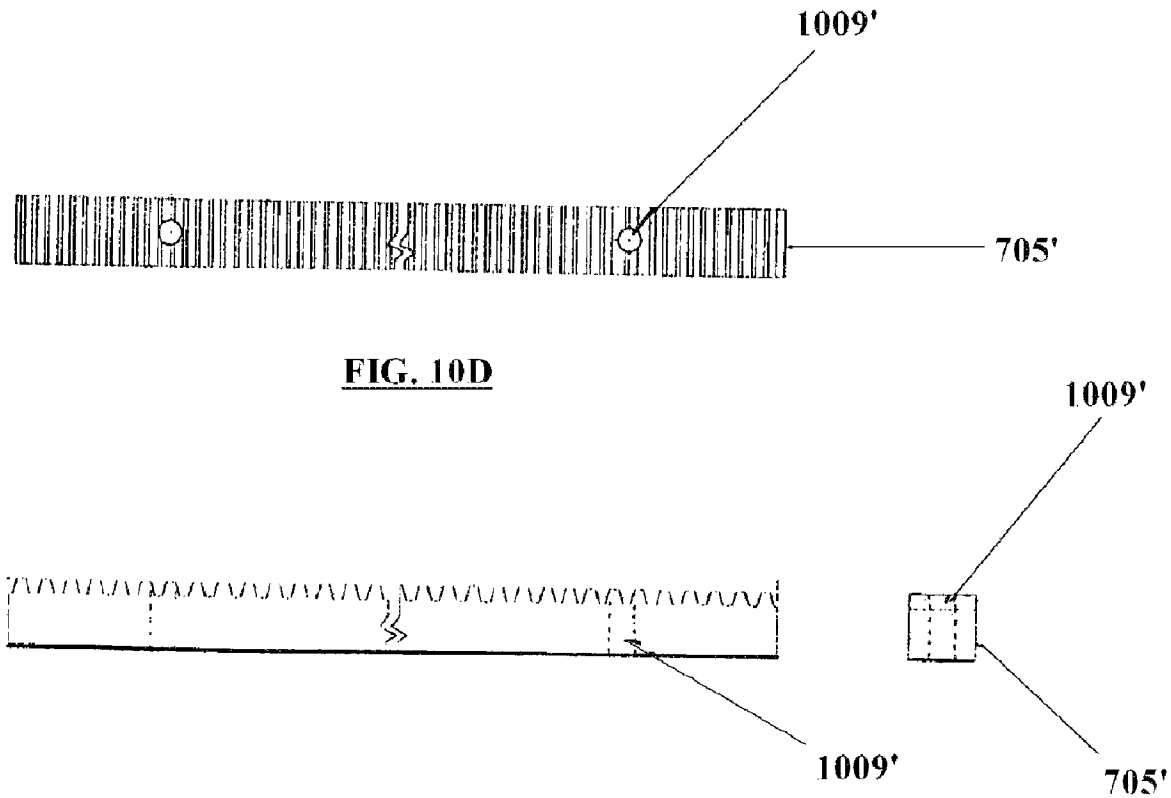
FIG. 10D is a top view showing an alternative embodiment of the rack of FIGS. 10A-10C.

Preferably, each gear rack 105, 106 is similar to gear rack 705 depicted in FIGS. 10A-10C. Gear rack 705 has a plurality of teeth 1025 on the upper surface thereof. Teeth 1025 correspond to and are engageable with teeth 825 of gear wheel 708 or 108. Lower portion 1037 of gear rack 705 has a plurality of holes 1009 for fixing the gear rack to side wall 122, 123 of channel 102, 103. In an alternative configuration, each gear rack 105, 106 is similar to gear rack 705' of FIG. 10D which, in turn, is similar to gear rack 705, except that holes 1009' of gear rack 705' extend in the thickness direction of the gear rack for fixing the gear rack to bottom wall 132, 133 of channel 102, 103. Gear racks 105, 106 can be attached to channels 102, 103 by welding or construction adhesive.

Returning now to FIG. 1, system 100 further includes a roller 110 riding on the top portion of axle 104. Roller 110 includes a "U" shaped plate 111 housing two opposing ball bearings (not shown in FIG. 1) each riding about 45 degrees from top center of axle 104. In a preferred configuration, "U" shaped plate 111 is wrapped around axle 104 to extend approximately one inch below the bottom side of axle 104. An elongated fastening member, such as bolt 112, is inserted below axle 104 and through "U" shaped plate 111. Punching bar 101 is attached to roller 110 by bolt 112 and a chain or cable 113. Chain or cable 113 is preferably attached to the top of punching bag 101 as can be seen in FIG. 1. Chain or cable 113 allows punching bag 101 to swing as in the conventional punching bag supporting or suspending devices. However, the unique arrangement of moveable axle 104 and roller 110 allows punching bag 101 to move differently from the conventional devices.

In operation, a trainee or user strikes punching bag 101 with a force F which can be analyzed as the sum of component force Fx, Fy and Fz, where Fx is a component force vector parallel to channels 102, 103, Fy is a component force vector parallel to axle 104, and Fz is a vertical component force vector. In this particular embodiment, Fx and Fy are horizontal force vectors. However, it is not necessarily the case, i.e., channels 102, 103 and axle 104 can be arranged in a non-horizontal plane or even need not be coplanar. Furthermore, channels 102, 103 and axle 104 are not necessarily straight or parallel/perpendicular to each other.

Returning now to FIG. 1, when a trainee or user strikes punching bag 101 with force F, component force Fz may cause punching bag 101 to move upward. If component force Fz is sufficient to move punching bag 101 to or beyond axle 104, roller 110 will nevertheless remain on axle 104 due to bolt 112 and the upper wall of "U" shaped plate 111.

Component force Fx causes axle 104, roller 110 and punching bag 101 to move together along gear racks 105, 106. With the rolling movement of gear wheels 108 on gear racks 105, 106, axle 104 rotates about its axis (not shown) because gear wheels 108 are fixed to the ends of axle 104. However, the ball bearings of roller 110 move with axle 104 and remain in position on the topside of axle 104 whereas bolt 112 remains on the bottom side of axle 104. At the same time, component force Fy causes roller 110 and, hence, punching bag 101, to move along axle 104. Pins or stops (not shown) can be provided to limit the movement of roller 110 and punching bag 101 along axle 104. As a result, punching bag 101 is moved, when hit by the user with force F, in both directions of Fx and Fy. In the ideal case, punching bag 101 would move in the direction of Fxy which is the sum of Fx and Fy. However, due to various factors, such as friction, the actual moving direction of punching bag 101 may be different from the direction of Fxy. Thus, punching bag 101 can move, when hit by the user, to any point within an area defined by the length of channels 102, 103 or gear racks 105, 106 and the distance therebetween or the length of axle 104. In practice, when the user hits punching bag 101, punching bag 101 moves not only in the general direction of Fxy, but also with a swinging motion. Such a swinging motion causes punching bag 101 to behave like a suspended pendulum, i.e., to move not necessarily linearly and to return, again not necessarily linearly, towards the user when it has reached the end of the movement imparted by the user's strike. However, due to various factors, such as friction and the above mentioned swinging motion, punching bag 101 will not return exactly in the same trajectory to the same, initial position where it was hit by the user, As a result, punching bag 101 will settle at a new position within the area. This is unlike the conventional devices wherein the punching bag merely swings around a stationary position, when hit, and eventually returns to the stationary position. In addition, the return and forward paths of punching bag 101 in the present invention are much less predictable, if at all, than in the conventional devices where the punching bags generally return in substantially the same or similar trajectories.

It is within the scope of the present invention to provide other alternative configurations. For example, "C" shaped channels 102, 103 can be "L" shaped and/or two gear racks, i.e., an upper gear rack and a lower gear rack, can be provided in each of channels 102, 103. Axle 104 is not necessarily perpendicular to channels 102, 103 which in turn are not necessarily parallel. Axle 104 can be either solid or hollow. Components of system 100 are preferably made of metal, but other materials are not excluded.

Figure 2:
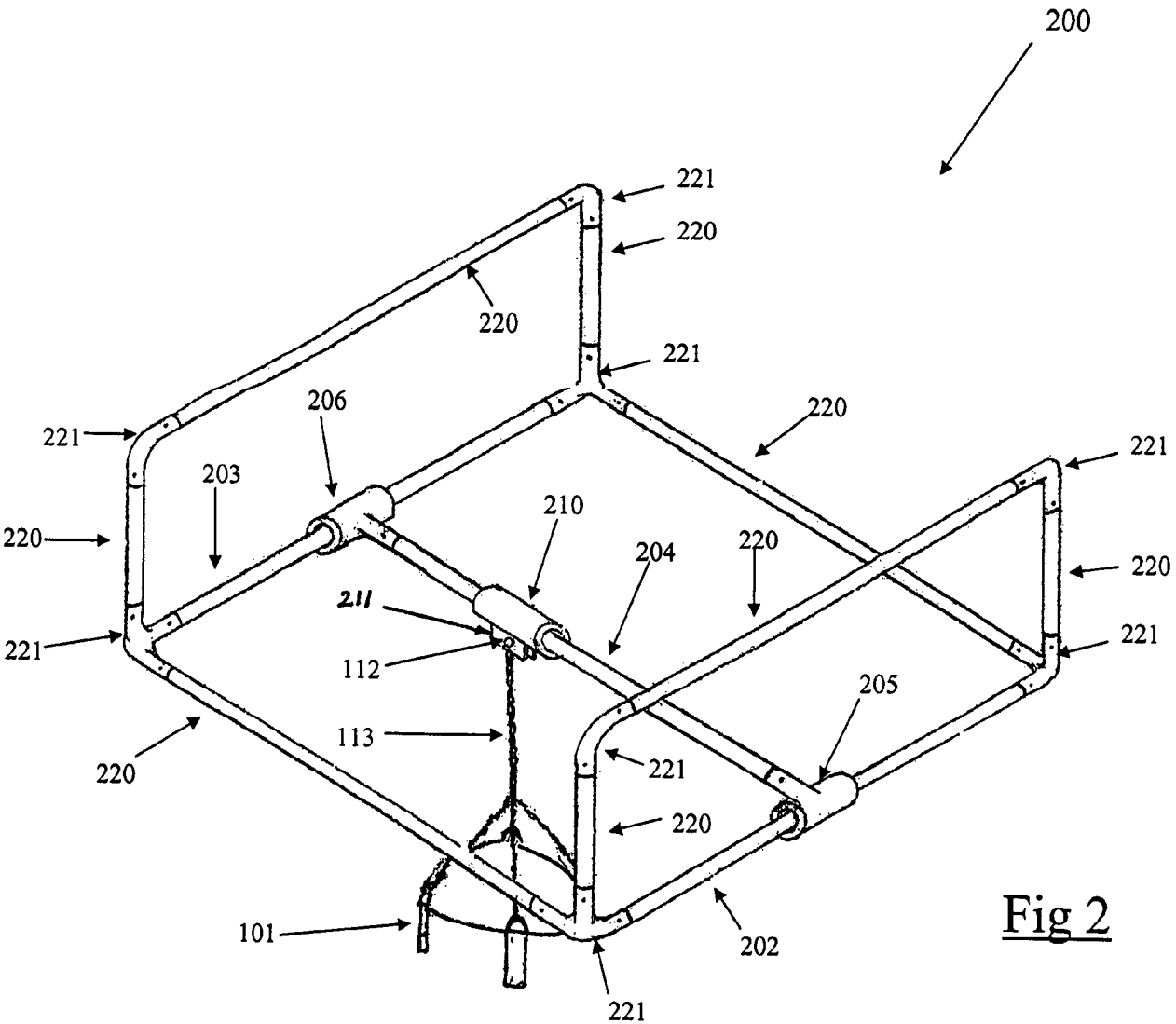
FIG. 2 is a perspective view of a sports training system in accordance with a second embodiment of the present invention.

FIG. 2 is a perspective view of a sports training system 200 in accordance with a second embodiment of the present invention.

System 200 includes two metal (or other suitably hard material) tubes 202, 203 which, in a preferred configuration, are approximately 2.5 inches in diameter and six feet in length. Tubes 202, 203 are spaced six feet apart and parallel with each other. Similar to channels 102, 103, the lengths and diameters of tubes 202, 203 can be varied depending on the desired strength of the system and movements of punching bag 101 suspended below a transverse tube 204 moveably supported by tubes 202, 203.

Riding over each of tubes 202, 203 is a bushing 205, 206 which, in a preferred configuration, are approximately one foot in length. Preferably, transverse tube 204 is a 2.5 inch diameter tube, six foot in length, spans and attaches, e.g., by welding, to bushings 205, 206 and moves perpendicular to parallel tubes 202, 203. The tube length can be longer or shorter depending on the desired bag movements. Bushings 205, 206 can have a "T" shape as shown in FIG. 2 but other configurations are not excluded.

Riding over transverse tube 204 is a bushing 210 which, in a preferred configuration, is approximately one foot in length. Attached to bushing 210 are a "U" shaped plate 211 with a bolt 112 connecting the lower ends of plate 211.

System 200 operates similarly to system 100 in that when a trainee or user strikes punching bag 101, transverse tube 204, bushing 210 and punching bag 101 are caused to move together along tubes 202, 203, whereas bushing 210 and punching bag 101 are caused to move along transverse tube 204. As a result, punching bag 101 can be moved to any point within an area defined by the lengths of tubes 202-204 and bushings 205, 206, 210. Again, as described with respect to system 100, a swinging motion will be imparted to punching bag 101 when it is hit. The swinging motion, coupled with the great moveability of the punching bag within the area, will cause the punching bag to move forward from the initial, stationary position, and then return to and settle at a new, unpredictable stationary position in a unpredictable trajectory.

However, the relative movements between the bushings and the respective tubes in the second embodiment are, unlike the first embodiment, sliding movements. Bearings (not shown) or appropriate lubrication can be provided between the bushings and the respective tubes to reduce friction.

System 200 preferably includes further tubes 220 for enhanced mechanical strength. Tubes 220 are connected to each other and to tubes 202, 203 by angled connectors 221. In accordance with the present invention, all or any of tubes 202-204 and 220 can be solid rods and is/are not necessarily circular in cross section.

Figure 3:
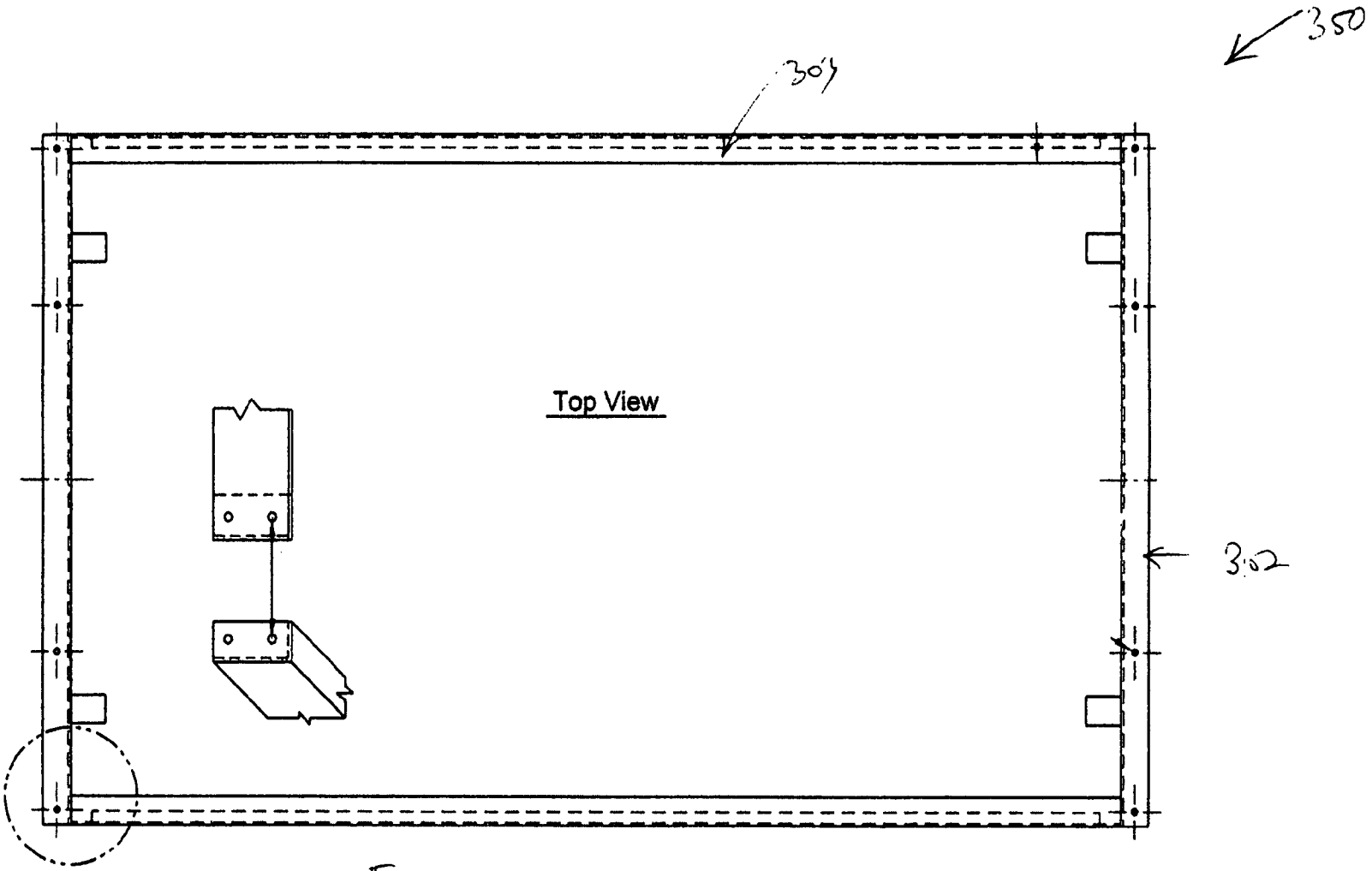
FIG. 3 is a top plan view of a supporting frame of a sports training system in accordance with a third embodiment of the present invention.
Figure 7A:
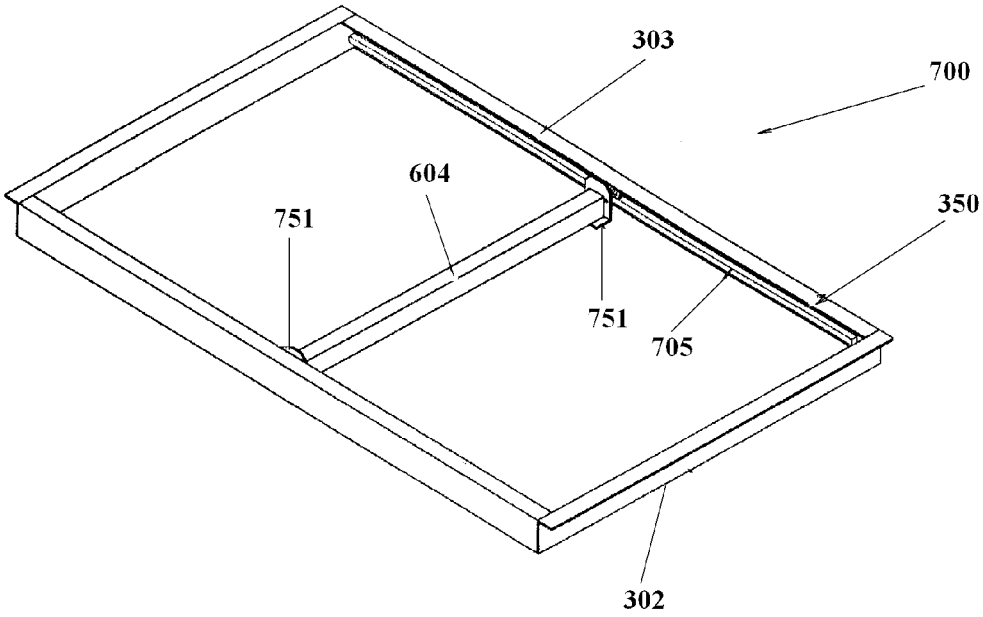
FIGS. 7A and 7B are respectively a perspective view and an exploded, perspective view of the moveable bar of FIGS. 6A-6C supported by the frame of FIG. 3.

FIG. 3 is a top plan view of a supporting frame 350 of a sports training system 700 (FIG. 7A) in accordance with a third embodiment of the present invention. Frame 350 includes two short beams 302 and two long beams 303 although the beams can be equally long to define a square frame.

Figures 4A, 4B, 5A, 5B, 5C:
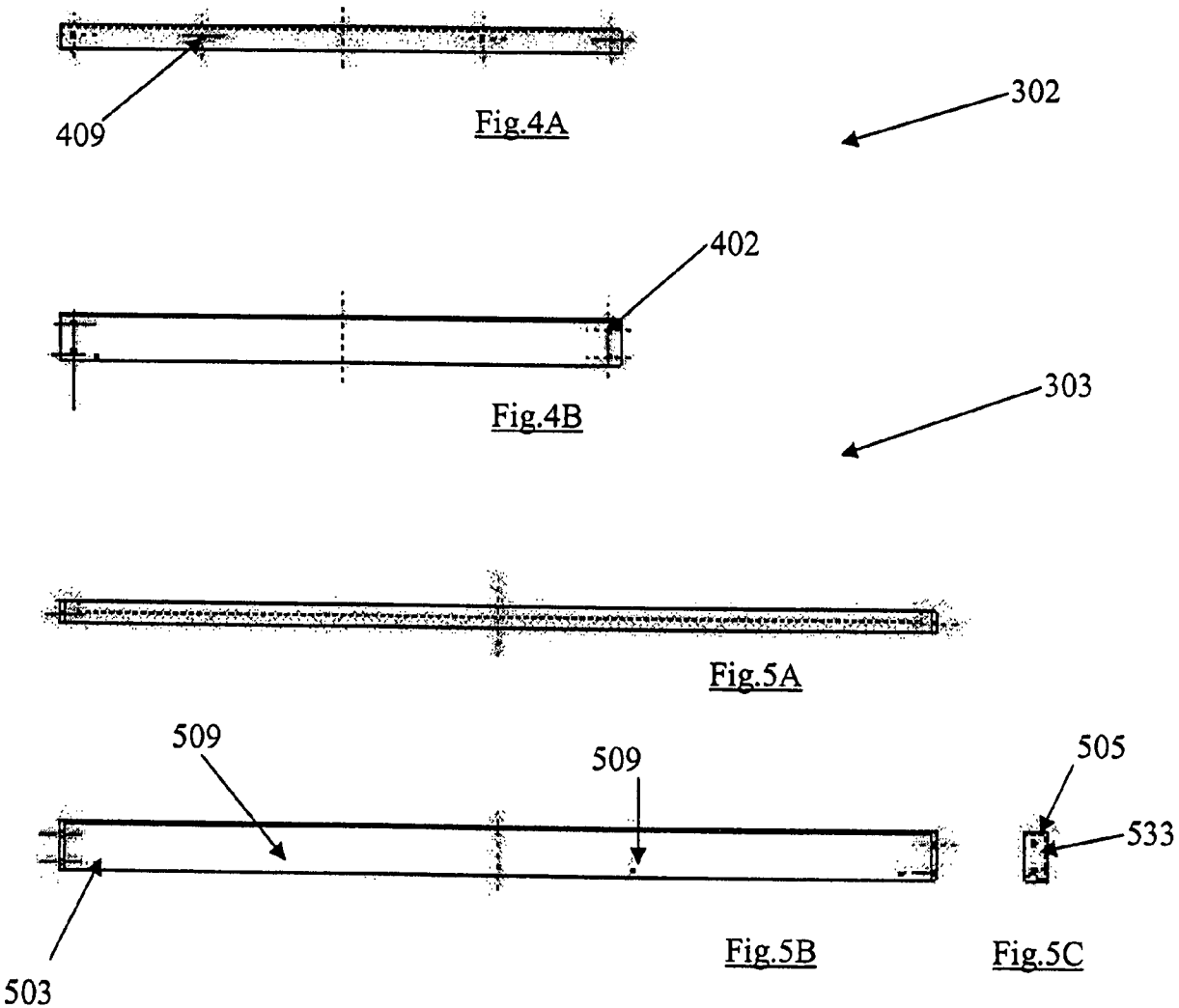
FIGS. 4A-AB are respectively top, and front views of the short bar of the frame of FIG. 3.
FIGS. 5A-5C are respectively top, front and side views of the long bar of the frame of FIG. 3.
Figure 7B:
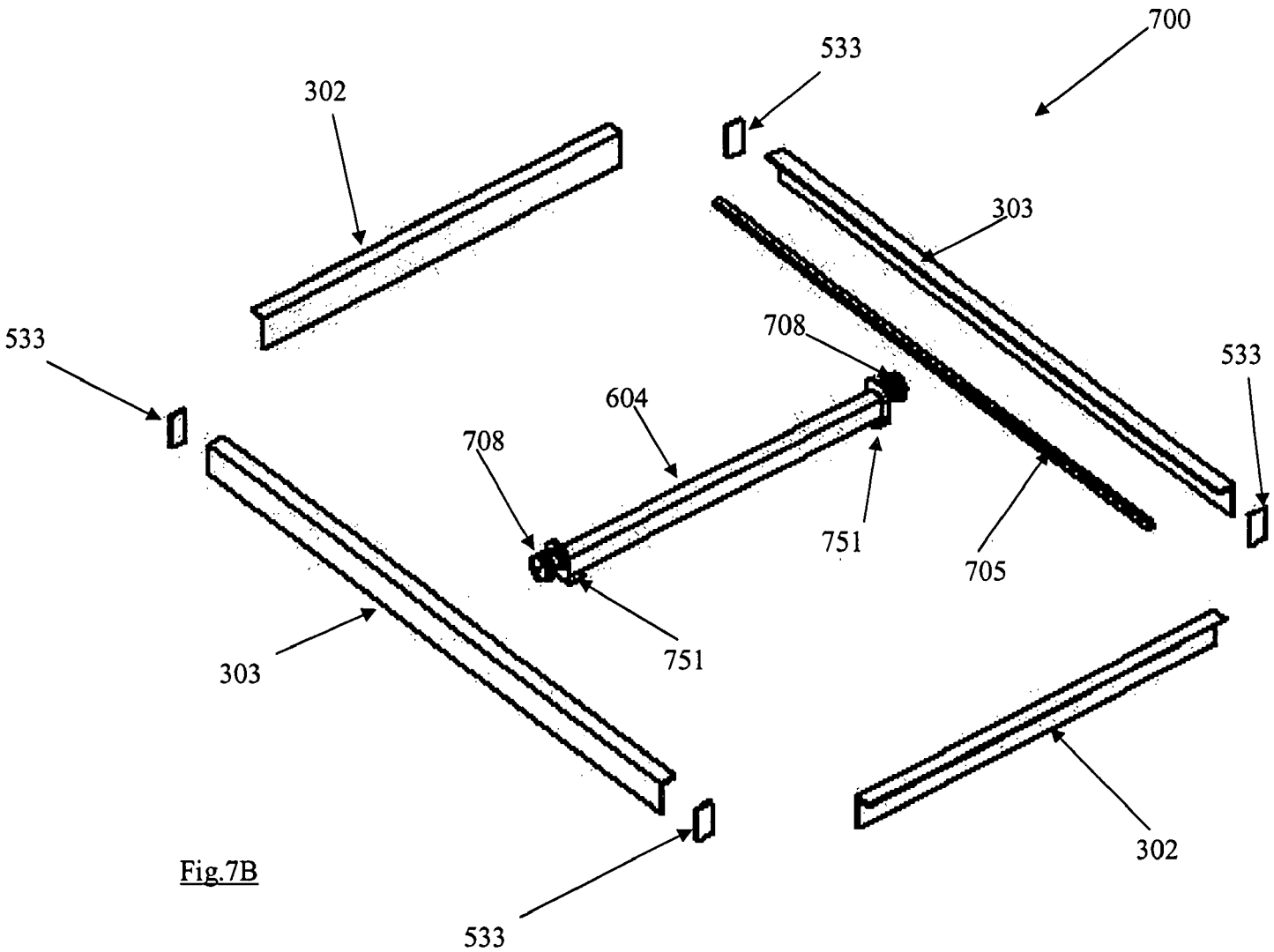

A short beam 302 is depicted in FIGS. 4A-4C. Short beams 302 are preferably "L" shaped as best seen in FIG. 7B. Short beams 302 are provided with numerous holes 402 for receiving bolts or fasteners of other types used to fasten short beams 302 with long beams 303. Likewise, holes 409 are provided to fasten frame 350 to a support, e.g., the ceiling or wall of a gym, a separate, free standing frame or a wall-mounted frame.

A long beam 303 is depicted in FIGS. 5A-5C. Like short beams 302, long beams 303 are preferably "L" shaped as best seen in FIG. 7B. Long beams 303 are also provided with numerous holes 503 for receiving bolts or fasteners of other types used to fasten short beams 302 with long beams 303. Likewise, holes 509 are provided to fasten gear racks (will be discussed herein below) to long beams 303. Preferably, short beam 302 and short beam 302 are cut from the same stock material.

Corner connectors 533 (best seen in FIG. 5C) are also provided to connect short beams 302 to long beams 303 as best seen in FIG. 7B. Holes 505 are formed, e.g., by drilling, for this purpose. Preferably, corner connectors 533 are welded or adhesively fixed to the opposite ends of long beams 303. Then, bolts are inserted through aligned holes 505 of corner connectors 533 and holes 402 of short beams 302 to fasten long beams 303 to short beams 302.

Figure 19:
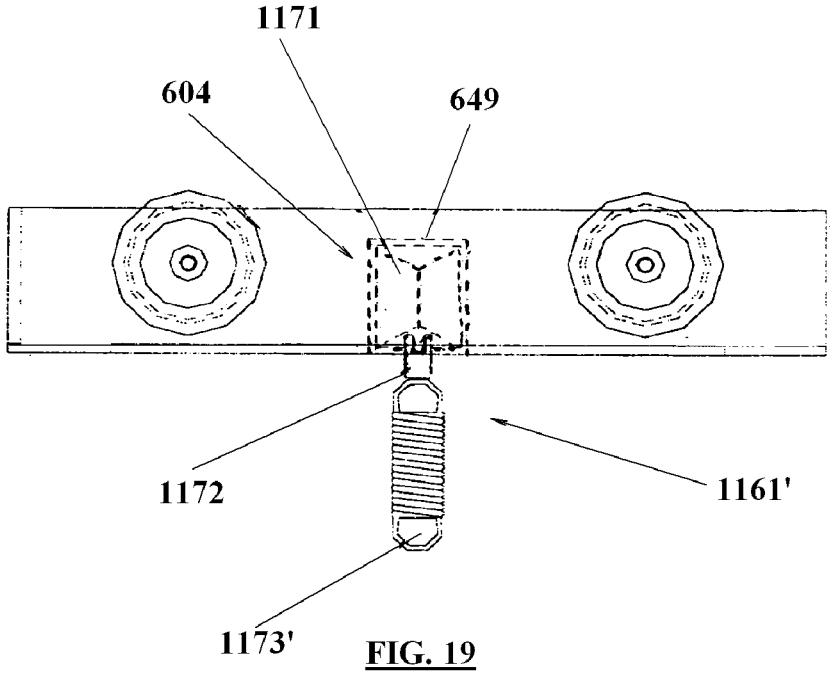
FIG. 19 is an enlarged view of FIG. 18C.

FIGS. 6A-6C are respectively top, front and side views of a moveable bar 604 to be used with frame 350 of FIG. 3. As can be seen in FIG. 6C, moveable bar 604 has an opened box shape with a longitudinal slot 641 at the bottom side. Longitudinal slot 641 has raised edges which define longitudinal gutters or grooves 643 on either side of longitudinal slot 641 as best seen in FIG. 6A. Holes 645 are also provided for receiving bolts or fasteners of other types used to fasten moveable bar 604 with the other components of sports training system 700 assembled in FIG. 7A. Upper wall 649 is provided to prevent a trolley truck to be moveably received in hollow space 648 of moveable bar 604 from derailing when punching bag 101 is hit upwardly by the user, as best seen in FIG. 19.

FIG. 7B is an exploded, perspective view of system 700. Frame 350 of system 700 is assembled by aligning holes 402, 503 and 505 of short beam 302, long beams 303 and corner connectors 533, respectively, and fastening the components with bolts of fasteners of other types. The short sides of the "L" shapes of short beam 302 are oriented outwardly, whereas the short sides of the "L" shapes of long beams 303 are oriented inwardly to prevent disengagement of moveable bar 604 from gear racks 705 of system 700. Two gear racks 705 (only one of which is visible in FIG. 7B) are fastened to long beams 303 by side holes 509 (best seen in FIG. 5B). Moveable bar 604 with gear wheels 708 attached to opposite ends thereof via mounting brackets 751 is moveably supported by the engagement between gear wheels 708 and gear racks 705.

FIGS. 8A-8C are respectively top, front and side views of gear wheel 708. Gear wheels 708 are preferably spur gears with straight teeth although other types of gears are not necessarily excluded. Each gear wheel 708 has a first section 821 which has a greater diameter and teeth 825 and a second section 822 which has a smaller diameter and no teeth. A through hole 823 extends diametrically through second section 822. Another through hole 824 extends axially through both first section 821 and second section 822. FIG. 12 shows a pin 1215 sized and shaped to be receivable in through hole 823 of second section 822. Through holes 823 and 824 are communicated with each other at 826, FIG. 8A. The functions of through holes 823 and 824 will be described hereinafter.

Figure 9C:
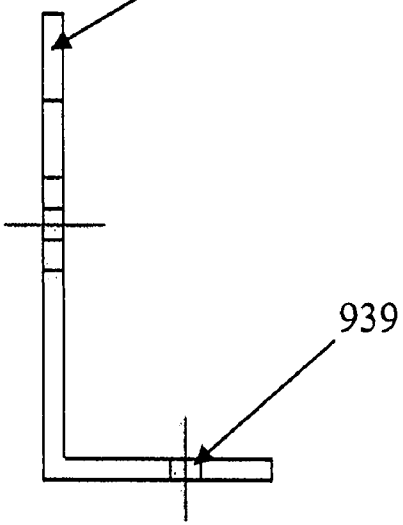
FIGS. 9A-9C are respectively top, front and side views of a mounting bracket used to rotatably attach the gear wheel of FIGS. 8A-8C to the moveable bar of FIGS. 6A-6C as shown FIG. 7.
Figure 9A:
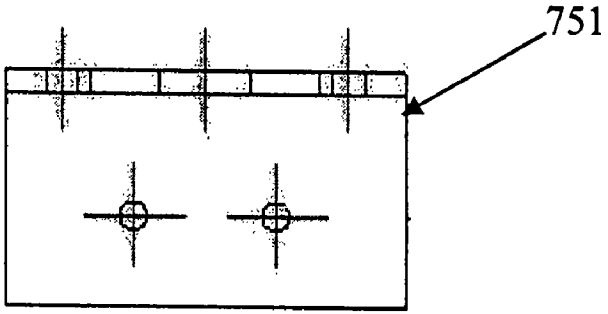
Figure 9B:
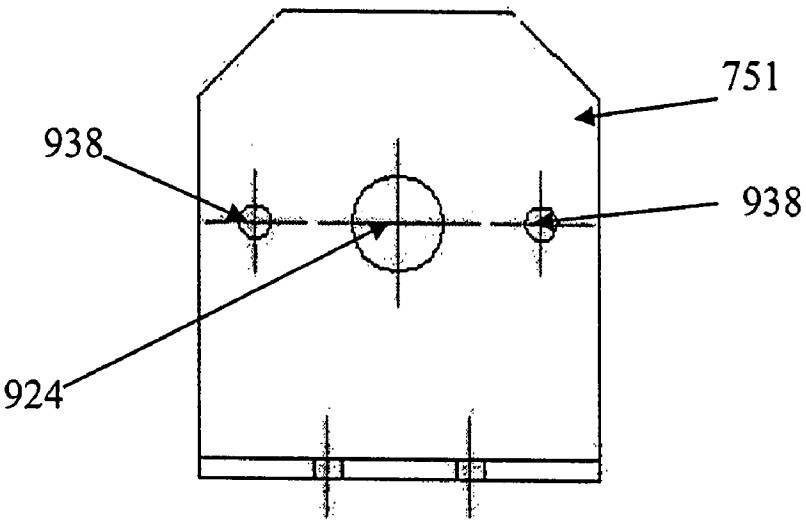

FIGS. 9A-9C are respectively top, front and side views of mounting bracket 751. Mounting bracket 751 is preferably "L" shaped and provided with numerous holes for connection with moveable bar 604 and gear wheels 708. In particular, mounting bracket 751 has a central hole 924 corresponding to through hole 824 of gear wheel 708, holes 938 for connection with gear wheel 708 and holes 939 for connection with moveable bar 604.

FIGS. 10A-10C are respectively top, front and side views of gear rack 705. Gear rack 705 has a plurality of teeth 1025 on the upper surface thereof. Teeth 1025 correspond to and are engageable with teeth 825 of gear wheel 708. Lower portion 1037 of gear rack 705 has a plurality of holes 1009 corresponding to side holes 509 of long beams 303.

Figures 11A, 11B, 11C:
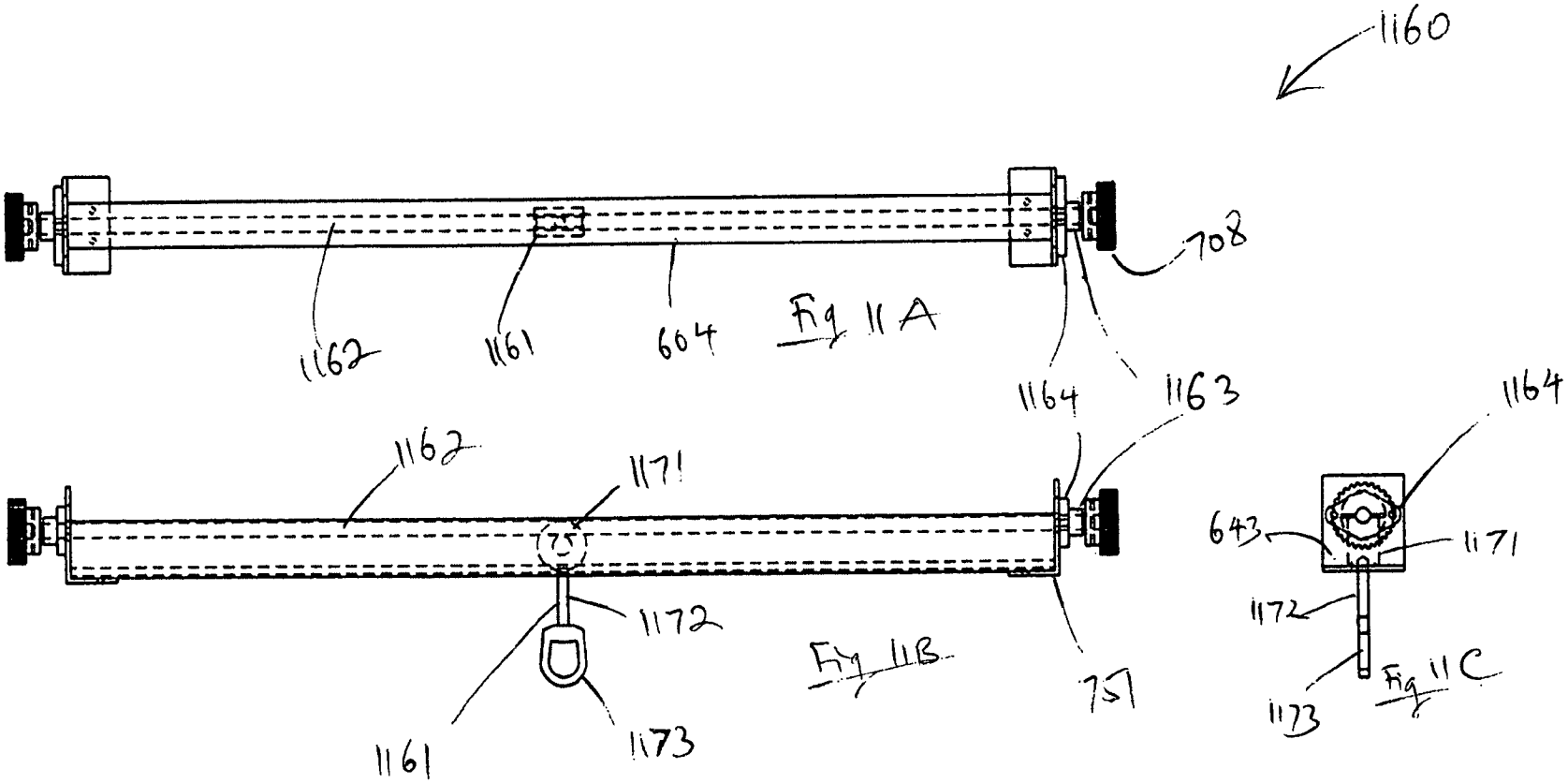
FIGS. 11A-11C are respectively top, front and side views of a trolley track assembly to be mounted on the frame of FIG. 3 to complete the sports training system in accordance with the third embodiment.

Gear wheel 708, mounting bracket 751, moveable bar 604, and a trolley truck 1161 are assembled as best seen in FIGS. 11A-11C to form a trolley track assembly 1160. Besides the above-listed components, trolley track assembly 1160 further comprises an elongated rod 1162 which extends through holes 824 of gear wheels 708 and holes 924 of mounting brackets 751. Rod 1162 is provided with two diametrical through holes (not shown) at opposite ends thereof. Each of pins 1215 is inserted into one of the diametrical through holes of rod 1162 and hole 823 of the corresponding gear wheel 708 to fix gear wheels 708 to the respective ends of rod 1162. Thus, rod 1162 rotates about its axis (not shown) when gear wheels 708 roll on the respective gear racks 705. Mounting brackets 751 are fastened to moveable bar 604 by aligning holes 939 of mounting brackets 751 with corresponding holes 645 of moveable bar 604, and inserting bolts or fasteners of other types therethrough. Lock nuts 1163 and washers 1164 are also used to properly assemble the components.

Trolley truck 1161 includes a double wheel structure 1171 at an upper portion thereof. An enlarged view of an alternative configuration of double wheel structure 1171 is provided in FIG. 19. An intermediate portion 1172 connects double wheel structure 1171 with an eye or hook 1173 adapted to suspend punching bag 101 therefrom. Intermediate portion 1172 extends through longitudinal slot 641 of moveable bar 604, with each wheel of double wheel structure 1171 riding in one of grooves 643. Trolley truck 1161 can be mounted on moveable bar 604 by inserting double wheel structure 1171 into an open end of 676 of moveable bar 604 prior to closing the end 676 with one of mounting brackets 751.

In assembled system 700 (FIG. 7A), trolley truck 1161 is moveable along moveable bar 604 between mounting brackets 751 as a result of rolling movements of double wheel structure 1171 in the respective grooves 643 of moveable bar 604. Moveable bar 604, on the other hand, is moveable along gear racks 705 as a result of the engagement between gear wheels 708 and the respective gear racks 705. Thus, system 700 operates similarly to systems 100 and 200 in that punching bag 101 can be moved, when hit, to any point within an area defined by the lengths of gear racks 705 and the length of moveable bar 604 between mounting brackets 751. Again, as described with respect to system 100, a swinging motion will be imparted to punching bag 101 when it is hit. The swinging motion, coupled with the great moveability of the punching bag within the area, will cause the punching bag to move forward from the initial, stationary position, and then return to and settle at a new, unpredictable stationary position in a unpredictable trajectory. Thus, unlike the conventional devices, punching bag 101 will not return to the initial position where it was hit.

System 700 is stronger and more reliable than system 100 of the first embodiment. In the first embodiment, two bearings (not shown) are positioned at 45 degrees inside "U" shaped plate 111 to allow roller 110 to move along a rotational axle 104. This arrangement is complicated and the bearings are subject to excessive wear. In system 700, such bearings can be eliminated because the "roller," i.e., double wheel structure 1171 or trolley truck 1161, does not travel directly on a rotational axle, i.e., rod 1162, but on the solid, bottom surfaces of gutters or grooves 643 of moveable bar 604. Therefore, double wheel structure 1171 or trolley truck 1161 can last longer than roller 110 of the first embodiment. Double wheel structure 1171 or trolley truck 1161 of the third embodiment is also superior to bushing 210 of the second embodiment in that friction is greatly reduced.

Figure 13:
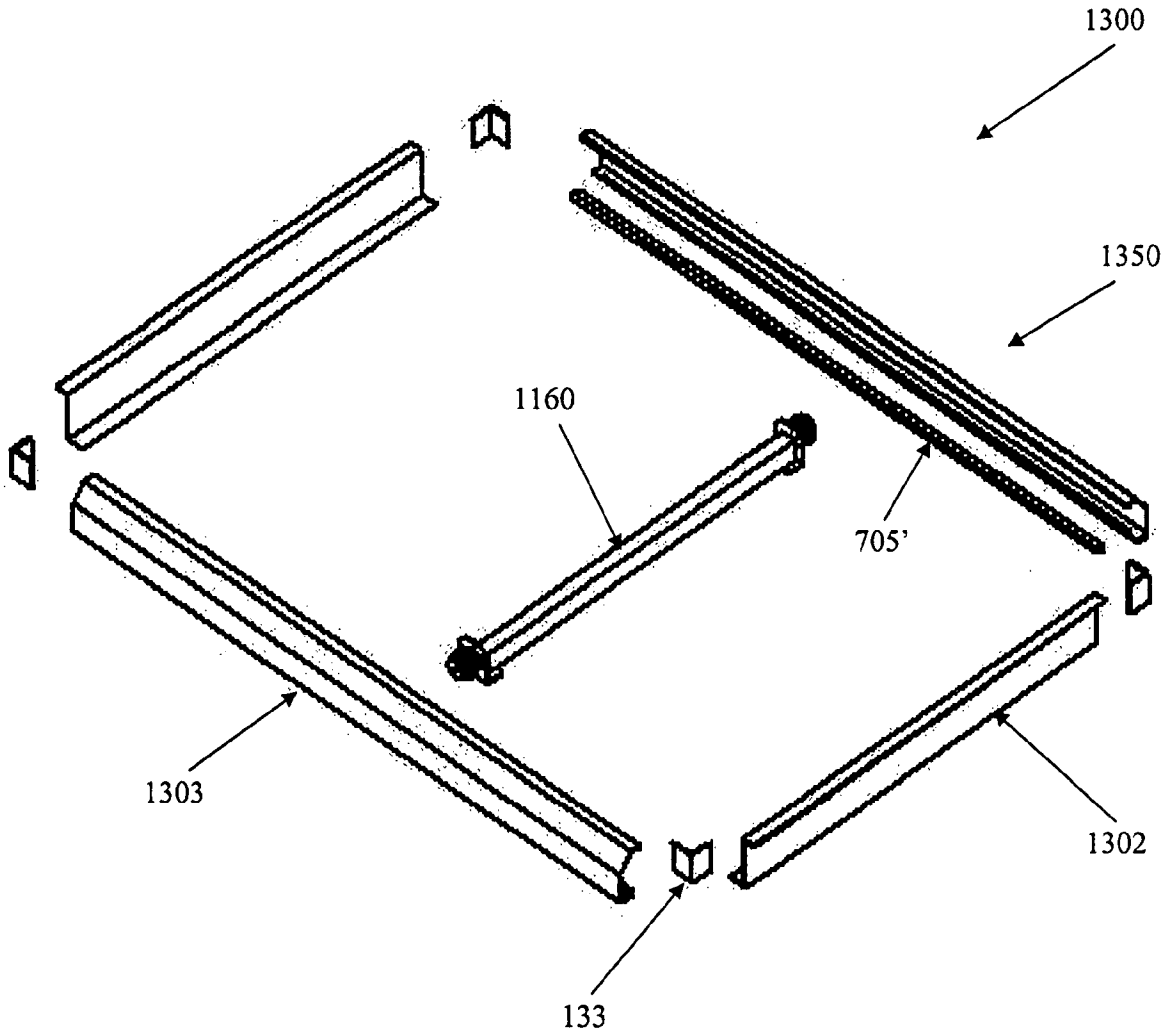
FIG. 13 is an exploded, perspective view of a sports training system in accordance with a fourth embodiment of the present invention.

FIG. 13 is an exploded, perspective view of a sports training system 1300 in accordance with a fourth embodiment of the present invention. System 1300 is similar to system 700 of the third embodiment, except for the frame or supporting structure 1350. In other words, the trolley track assembly in system 1300 is similar to trolley track assembly 1160 of system 700 and will not be described again.

Frame 1350 in system 1300 includes short beams 1302 and long beams 1303 although the beams can be equally long to define a square frame.

Figures 14A, 14B, 14C:
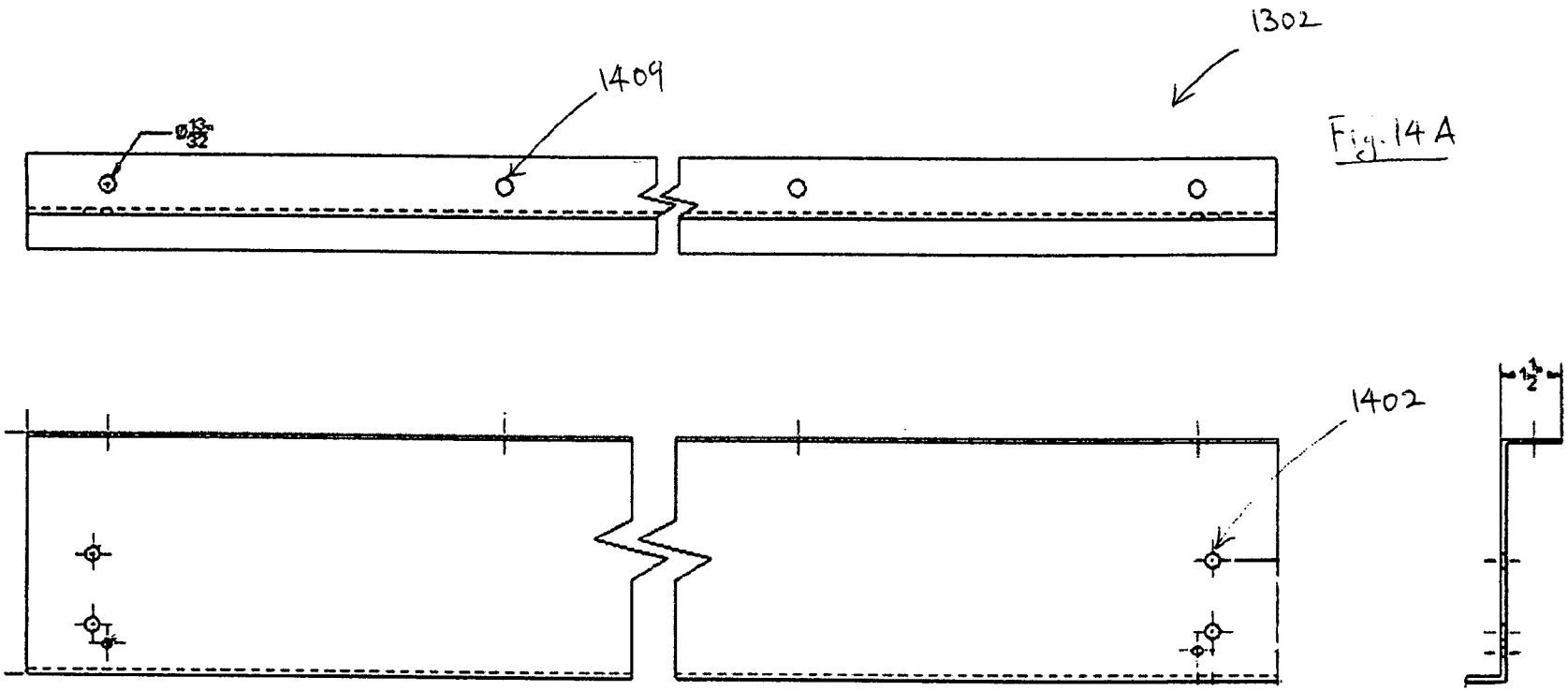
FIGS. 14A-14C are respectively top, front and side views of the short bar of the frame of FIG. 13.

A short beam 1302 is depicted in FIGS. 14A-14C. Short beams 1302 have a cross section close to "Z" shaped as best seen in FIG. 14C. This "Z" shape cross section gives short beam 1302 a greater mechanical strength than short beams 302 of the third embodiment. Short beams 1302 are provided with numerous holes 1402 for receiving bolts or fasteners of other types used to fasten short beams 1302 with long beams 1303. Likewise, holes 1409 are provided to fasten frame 1350 to a support, e.g., the ceiling of a gym.

Figures 15A, 15B, 15C:
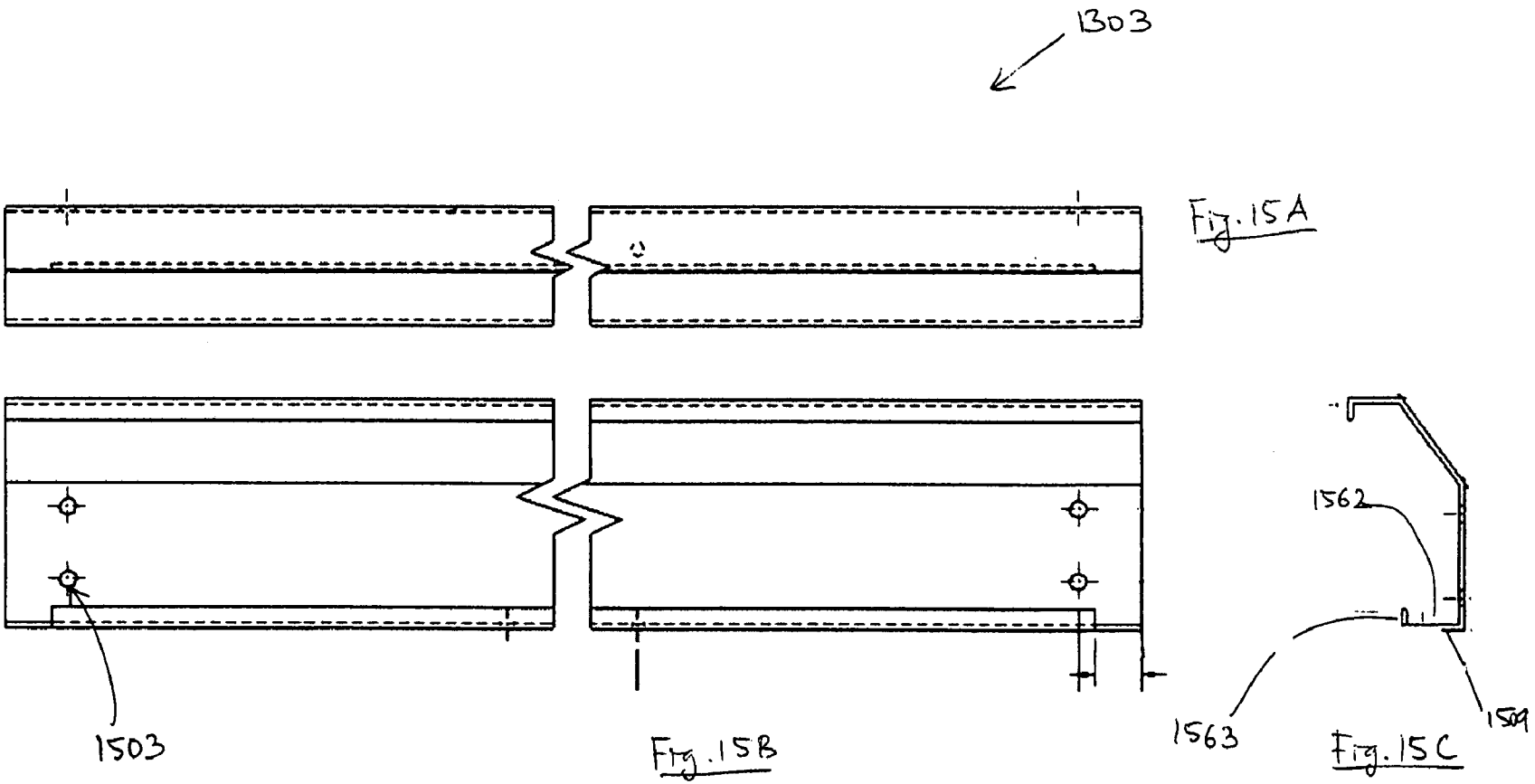
FIGS. 15A-15C are respectively top, front and side views of the long bar of the frame of FIG. 13.

A long beam 1303 is depicted in FIGS. 15A-15C. Long beams 1303 are configured to have a greater mechanical strength than long beams 303 of the third embodiment. An exemplary configuration is illustrated in FIG. 15C. Unlike long beams 303 of the third embodiment, each long beam 1303 in the fourth embodiment has a bottom wall 1562 for supporting a gear rack 705' (FIG. 10D) which is similar to gear racks 705 of the third embodiment, except that holes 1009' of gear rack 705' extend in the thickness direction of the gear rack and are adapted to be aligned with corresponding holes of long beams 1603 to receive therein a fastening element such as a bolt. This arrangement further gives frame 1350 a greater mechanical strength than frame 350 of the third embodiment. A low rail 1563 is preferably provided for easy fixing and maintaining gear racks 705' in place. Long beams 1303 are also provided with numerous holes 1503 for receiving bolts or fasteners of other types used to fasten short beams 1302 with long beams 1303. Likewise, holes 1509 are provided to fasten gear racks 705' to long beams 1303.

Corner connectors 1333 (best seen in FIG. 13) are also provided to connect short beams 1302 to long beams 1303 as best seen in FIG. 13. Corner connectors 1333 include holes (not shown) for this purpose.

System 1300 operates similarly to the already described systems 100, 200 and 700. However, system 1300 is configured to be stronger and capable of sustaining greater mechanical load.

Figure 16A:
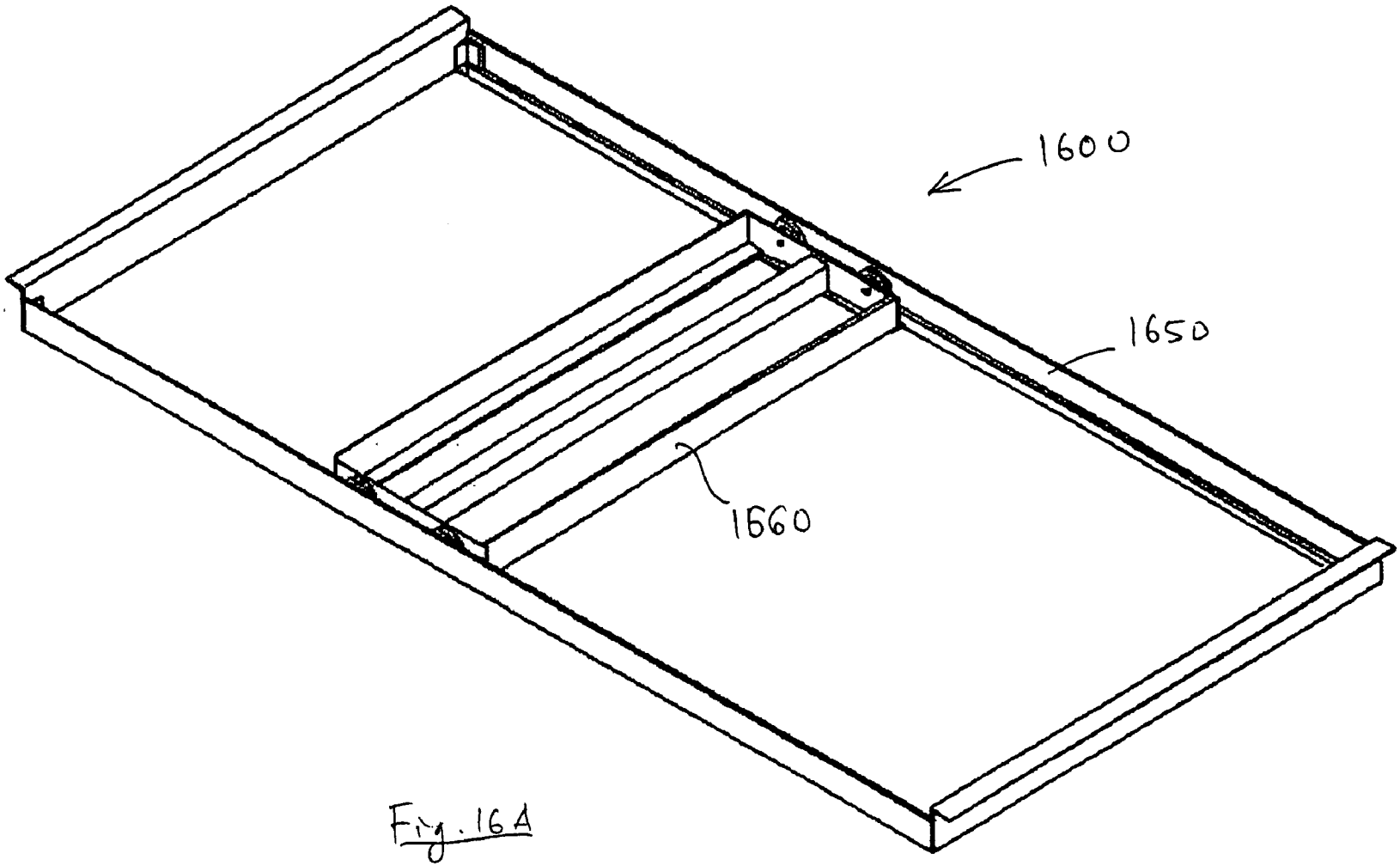
FIGS. 16A and 16B are respectively a perspective view and an exploded, perspective view of a sports training system in accordance with a fifth embodiment of the present invention.
Figure 16B:
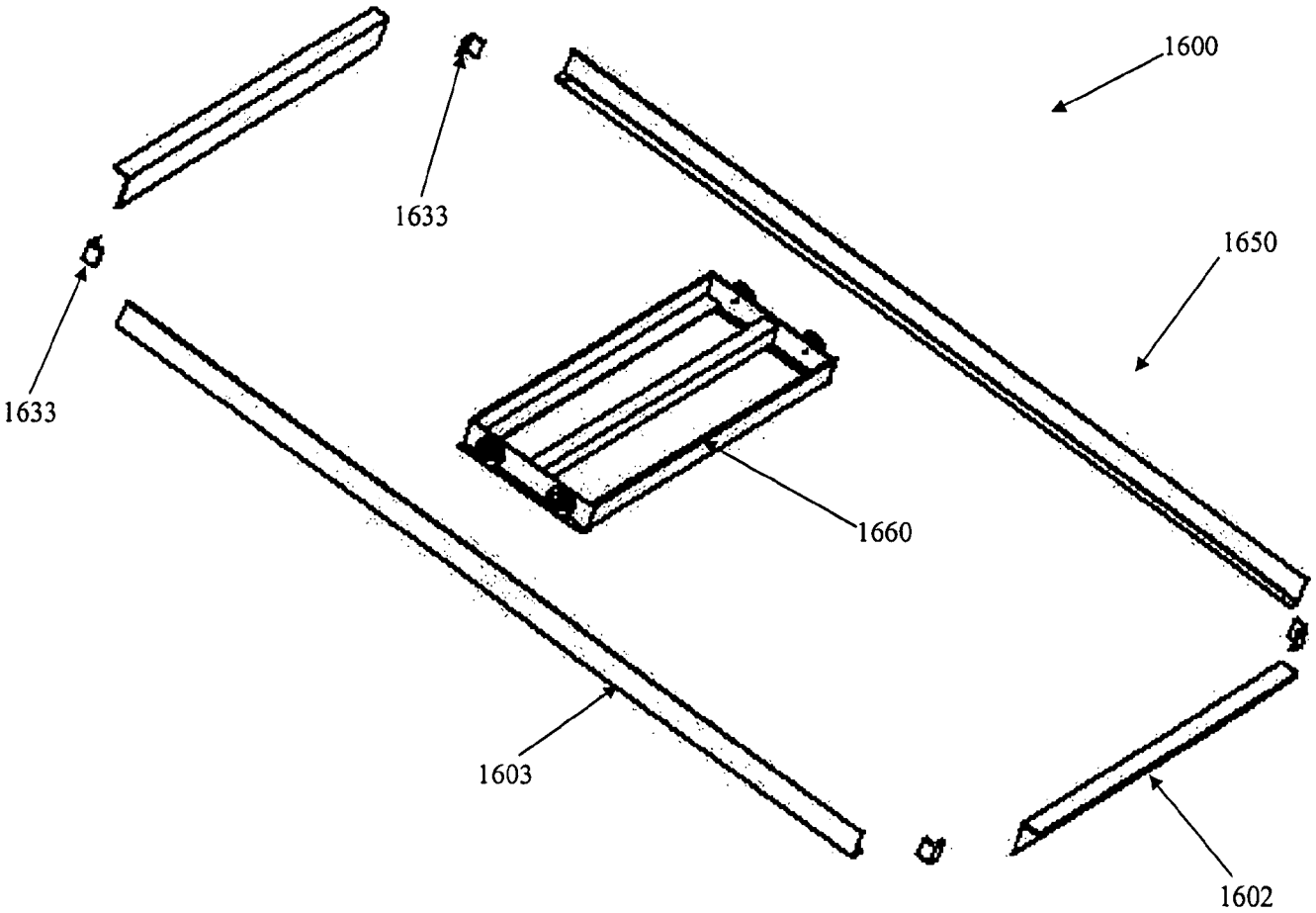

FIGS. 16A and 16B are respectively a perspective view and an exploded, perspective view of a sports training system 1600 in accordance with a fifth embodiment of the present invention. System 1600 includes a frame 1650 and trolley track assembly 1660 moveably supported by frame 1650.

Figures 16C, 16D, 16E:
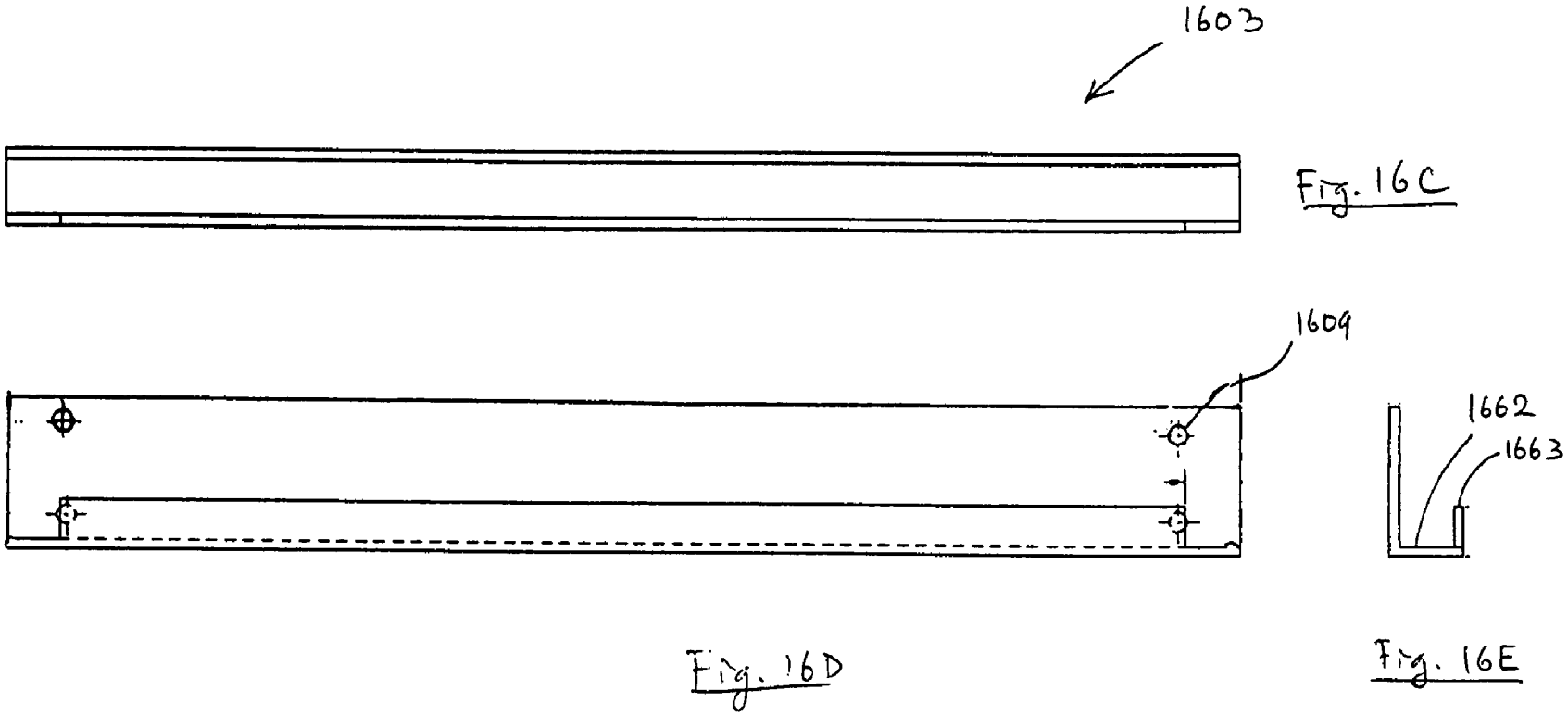
FIGS. 16C-16E are respectively top, front and side views of the long bar of the frame of FIG. 16A.

Frame 1650 is best illustrated in FIG. 16B and includes short beams 1602 and long beams 1603 although the beams can be equally long to define a square frame. Short beams 1602 is similar to short beams 302 of the third embodiment and will not be described again. A long beam 1603 is depicted in FIGS. 16C-16E. Long beams 1603 are relatively similar to long beams 303 of the third embodiment, except that each long beam 1603 further include a rail 1663 extending upwardly from an edge of bottom wall 1662 thereof. Rail or raised edge 1663 can be either formed integrally in a single piece with the remainder of long beam 1603, or formed separated and attached by, e.g., welding or construction adhesive, to the edge of a "L" shape portion similar to long beams 303 of the third embodiment. In the latter case, the "L" shape portion of long beam 1603 and short beams 1602 are preferably cut from the same stock material. Long beams 1603 are provided with numerous holes 1609 for receiving bolts or fasteners of other types used to fasten short beams 1602 with long beams 1603. Corner connectors 1633 (best seen in FIG. 16B) are also provided for this purpose.

Trolley track assembly 1660 is shown in FIGS. 17A-17B and 18A-18C which are respectively a perspective view, an exploded, perspective view, a top view, a front view and a side view of trolley track assembly 1660 of sports training system 1600. Trolley track assembly 1660 includes end bars 1702, side bars 1703, central bar 1704, grooved wheels 1708, and a trolley truck 1161'.

Central bar 1704 is similar to moveable bar 604 of the third embodiment and will not be described again. Trolley truck 1161' (FIG. 19) is similar to the corresponding element of the third embodiment in that both have similar double wheel structure 1171 and intermediate portion 1172. However, trolley truck 1161' has an attaching element for suspending punching bag 101 in form of a spring having eye 1173' similar to eye 1173 of the third embodiment.

Figure 17A:
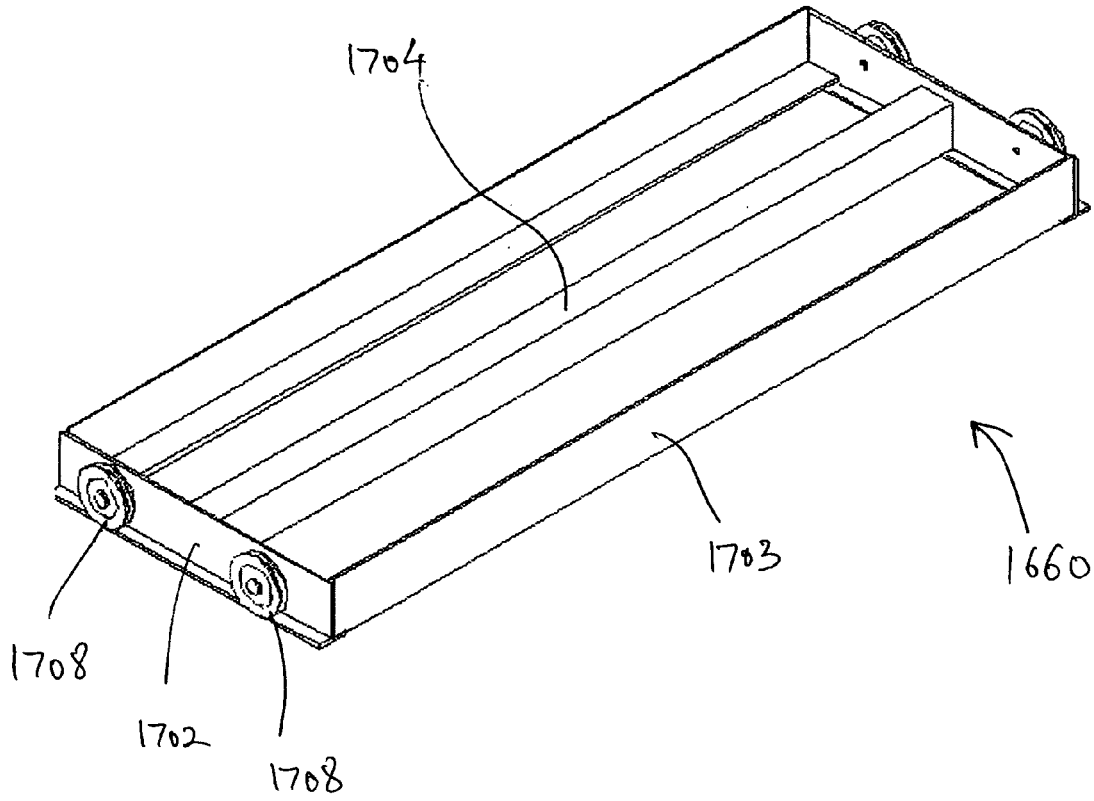
FIGS. 17A and 17B are respectively a perspective view and an exploded, perspective view of a trolley track assembly of the sports training system in accordance with the fifth embodiment shown in FIGS. 16A-16B.
Figure 17B:
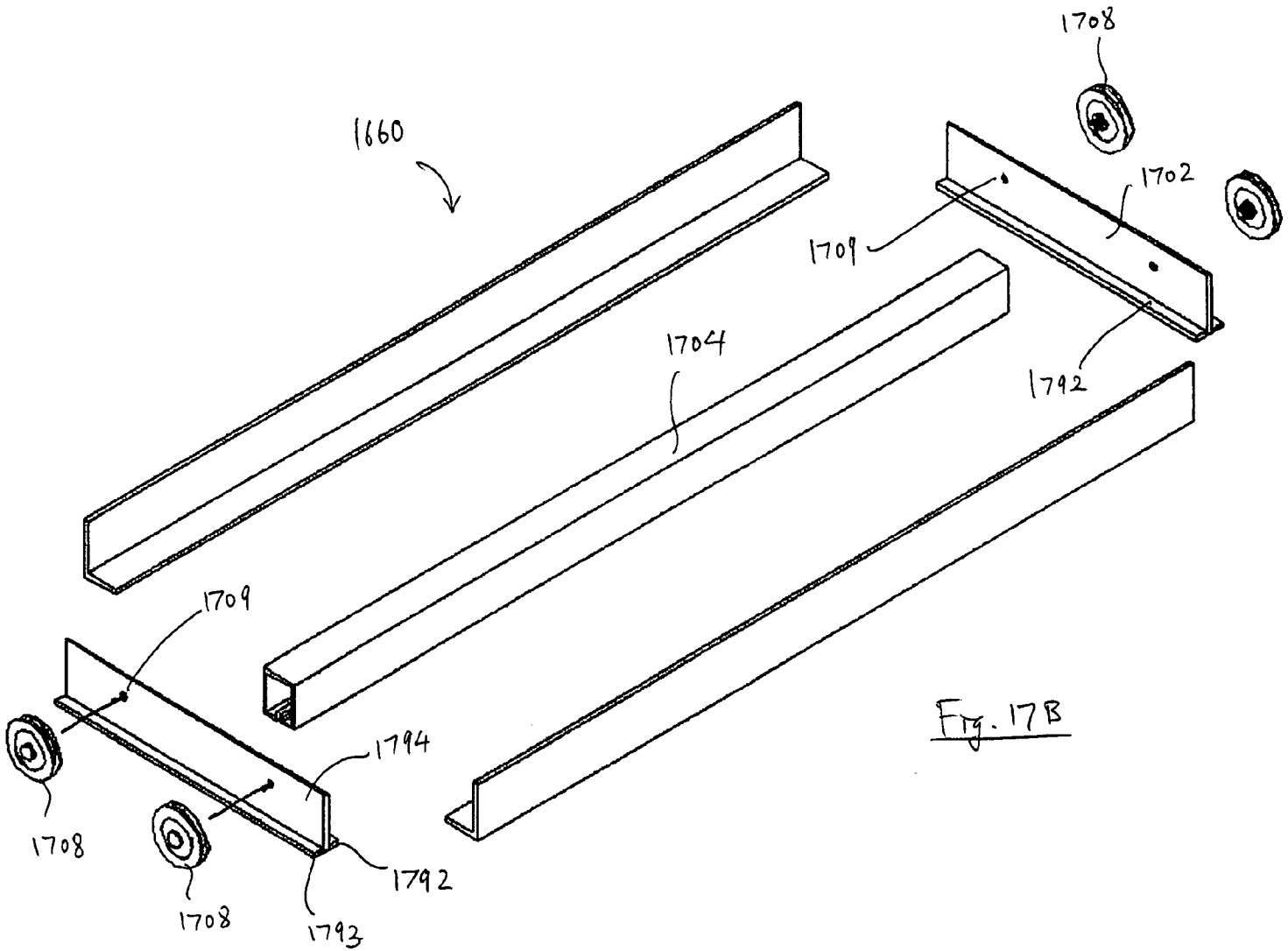

Each end bar 1702 has a "T" shaped cross section for improved mechanical strength. Each side bar 1703 has a "L" shaped cross section similar to short beams 302 and long beams 303 of the third embodiment. The bars are connected, preferably, without corner connectors as can be seen in FIG. 17A. Central bar 1704 is attached to inner section 1792 of each end bar 1702 by bolts and holes 1847 formed in the inner section and central bar 1704.

Figure 18A:
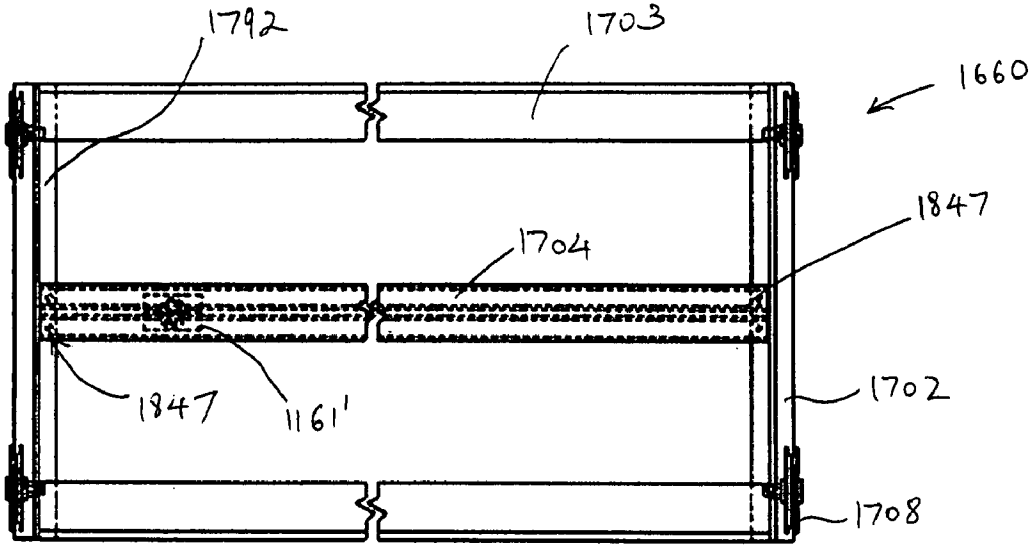
FIGS. 18A-18C are respectively top, front and side views of the trolley track assembly of FIGS. 17A-17B.
Figure 18B:
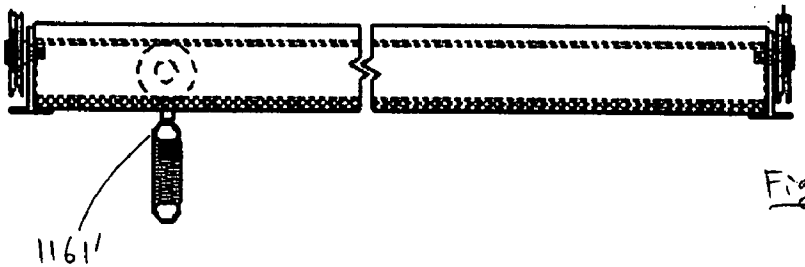
Figure 18C:
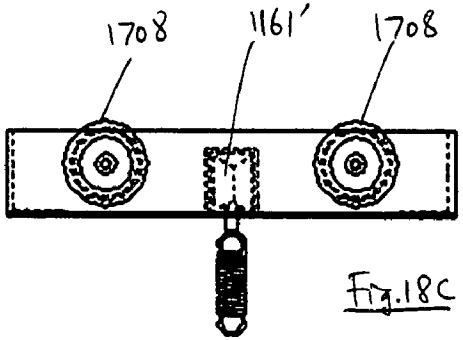
Figure 20A:
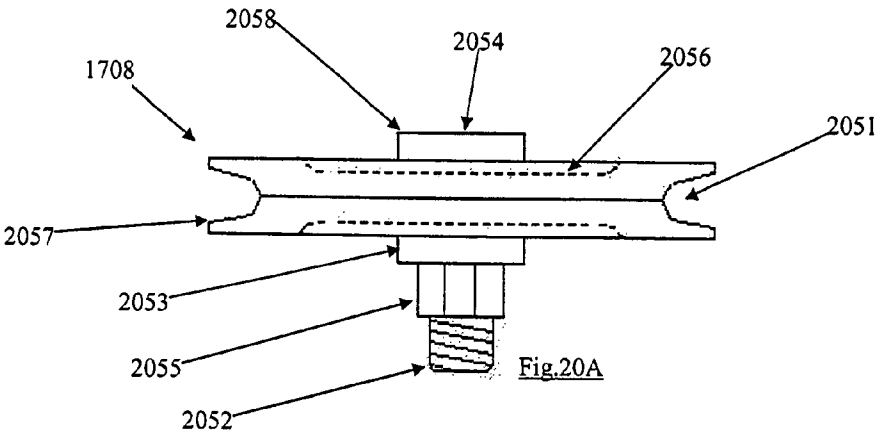
FIGS. 20A-20C are respectively top, front and side views of the trolley track wheels of the assembly shown in FIGS. 17A-17B.
Figure 20B:
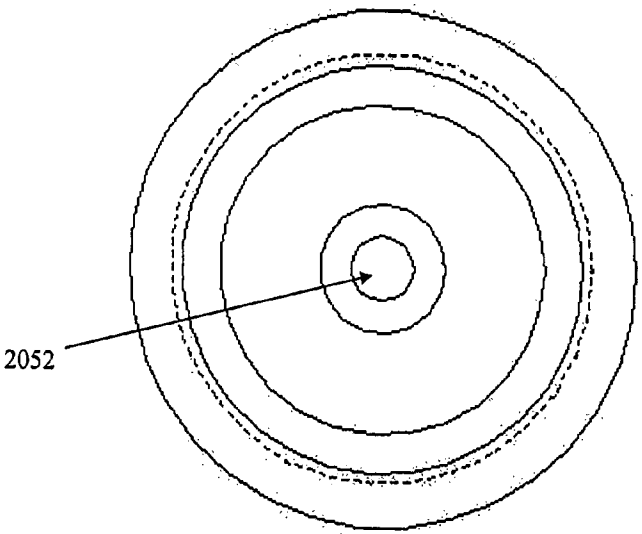
Figure 20C:
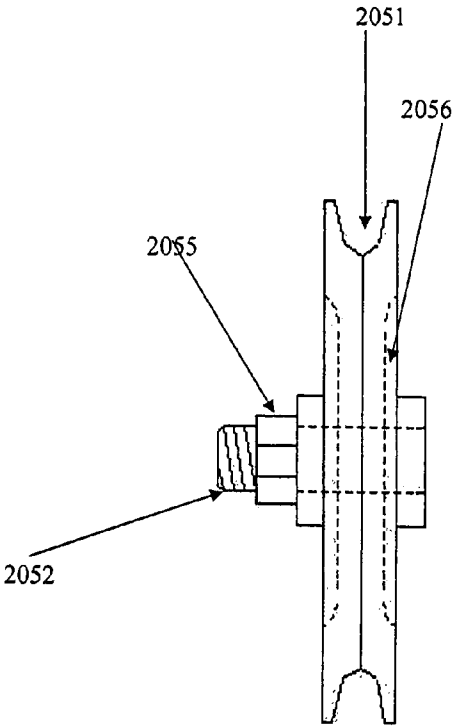

Each grooved wheel 1708 is individually, rotatably attached to one of end bars 1702, as best seen in FIG. 18A. A grooved wheel 1708 is depicted in detail in FIGS. 20A-20C and includes a wheel portion 2057 rotatably supported on an axle 2058 having opposite, inner and outer ends 2053 and 2054, respectively. Wheel portion 2057 further includes a circumferential groove 2051 which is configured to engage with and ride on rail 1663 of long beam 1603 of frame 1650 of system 1600. Axle 2058 further includes a threaded portion 2052 at an inner end thereof, and a bolt head section 2055 between the portion that supports wheel portion 2057 and threaded portion 2052. Threaded portion 2052 of each grooved wheel 1708 is screwed into a corresponding hole 1709 formed in a central section 1794 of end bar 1702. Hole 1709 can be optionally preformed with a matching thread. Bolt head section 2055 allows a technician to threadedly attach each grooved wheel 1708 to corresponding hole 1709 using a tool.

System 1600 operates similarly to the above described systems 100, 200, 700 and 1300 in that it allows punching bag 101 to move both along central bar 1704 and long beams 1603 in response to an user's strikes. Again, as described with respect to system 100, a swinging motion will be imparted to punching bag 101 when it is hit. The swinging motion, coupled with the great moveability of the punching bag within the area defined by central bar 1704 and long beams 1603 will cause the punching bag to move forward from the initial, stationary position, and then return to and settle at a new, unpredictable stationary position in a unpredictable trajectory.

The unique structure of trolley track assembly 1660 with side and end bars 1703, 1702 gives trolley track assembly 1660 additional mechanical strength in comparison to the previous embodiments where a single bar (104, 204, 604) is used. The use of two rows of wheels 1708 greatly reduces vibration and prevents central bar 1704 from rotating about its longitudinal axis which may be disadvantageous in a system, e.g., system 700, where a single row of wheels is used.

Figure 21A:
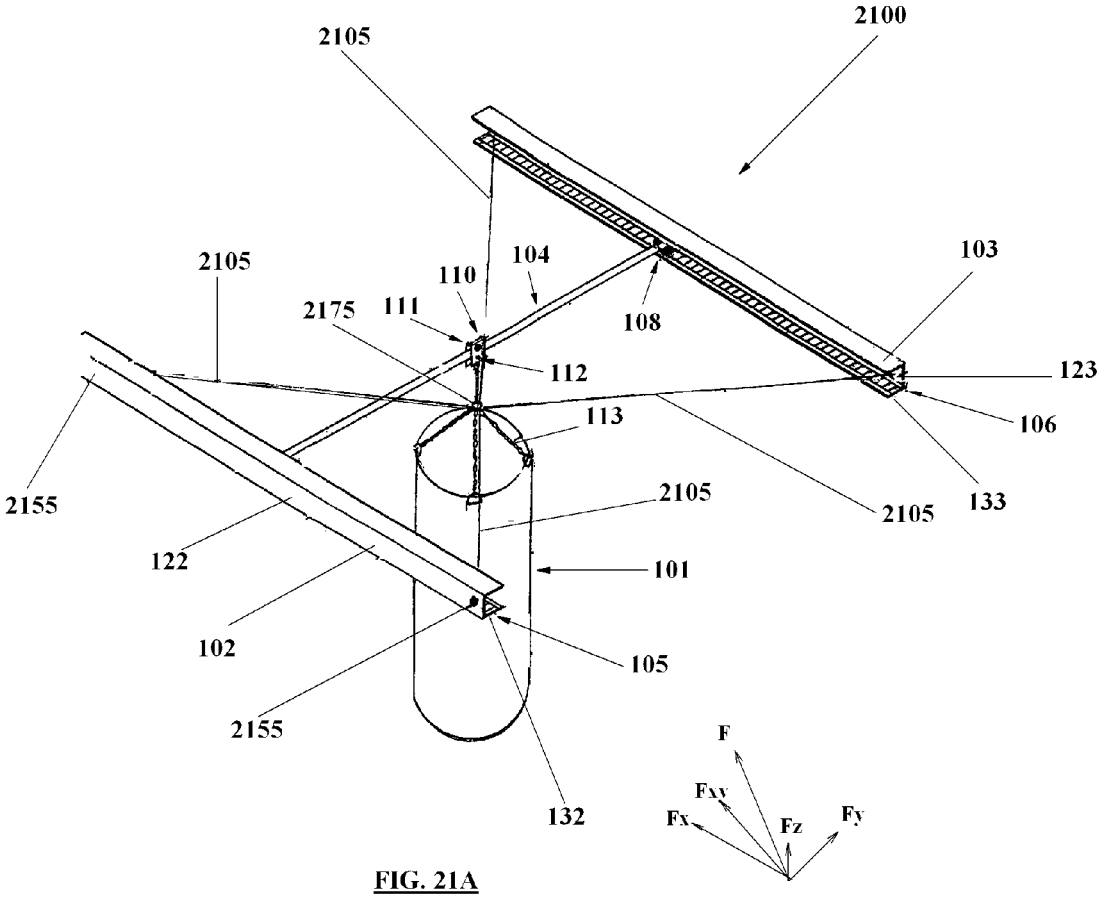
FIGS. 21A and 21B are views similar to FIGS. 1 and 7A, respectively, showing several configurations of a sixth embodiment of the present invention.
Figure 21B:
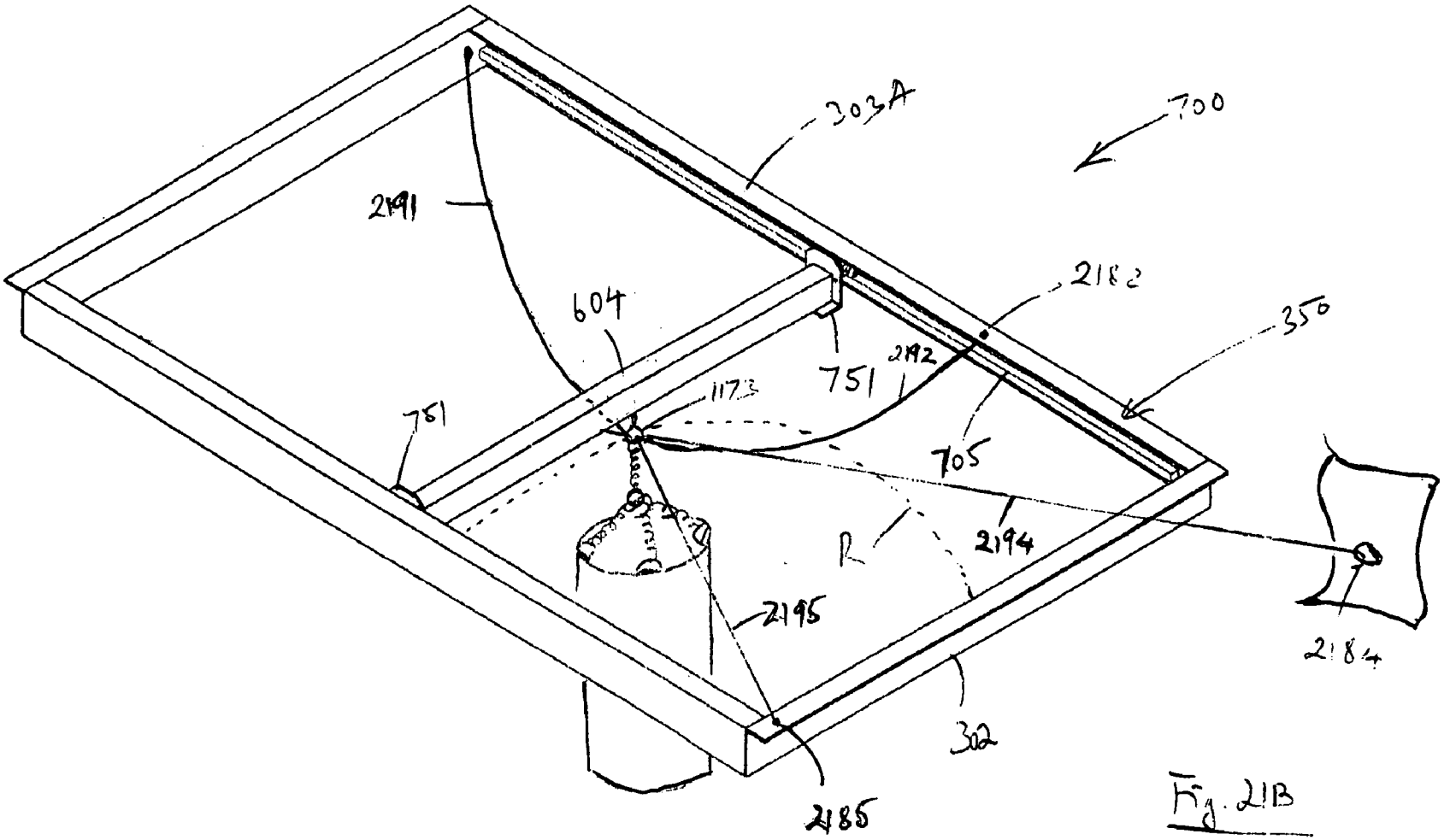

FIGS. 21A-21B show several, exemplary configurations of a sixth embodiment of the present invention. Specifically, FIG. 21A shows a system 2100 which is similar to system 100 of the first embodiment, except that system 2100 further includes a plurality of elastic elements 2105 attaching punching bag 101, at ring 2175 or chain 113, to the ends of channels 102, 103. Elastic elements 2105 are preferably bungee cords attached to channels 102, 103 by, e.g., knots designated at 2155. The cords preferably have an equal tension for keeping punching bag 101 centered within the area defined by channels 102, 103 and axle 104. Therefore, once the punching bag is struck, it moves away from the center but always moves back to the center unless struck again by the user. In this aspect, punching bag 101 in system 2100 moves differently from the punching bags in the systems of the above described embodiments.

However, the unpredictability of the punching bag movement remains in this sixth embodiment. More specifically, as described with respect to system 100, the swinging motion imparted to punching bag 101 when it is hit, coupled with the great moveability of the punching bag within the area defined by channels 102, 103, and the elastic (tensioning or compressive) forces generated by elastic elements 2105, will cause the punching bag to move forward in a unpredictable trajectory. Although the elastic forces will cause punching bag 101 to return to the initial position, the return trajectory will still be unpredictable, unlike the conventional devices where the punching bags return in substantially the same trajectory.

Elastic elements 2105 with different resistance or elasticity will cause the punching bag to move differently, i.e., faster or slower. Elastic elements 2105 are not necessarily identical and can have different diameter, length, elasticity, maximum elongation, pretension, compressive capability, etc. As a result, punching bag 101 is not necessarily centered within the area. Elastic elements can be of any types that have a "memory" or are elastically deformable, such as bungee cords, rubber or elastomeric strands, springs, or even air or hydraulic cylinders. In the latter case, the cylinders are preferably pivotably mounted to the supporting structure.

When punching bag 101 is at rest, elastic elements 2105 can be substantially straight as shown in FIG. 21A. However, one or some or all of the elastic elements may be slack to describe curves as depicted at 2191, 2192 in FIG. 21B. The elastic elements 2105 that are substantially straight when punching bag 101 is at rest can be tension-free or pre-tensioned or even pre-compressed. It is not excluded to mix some of the above listed states, i.e., slack, tension-free, pre-tensioned, and pre-compressed, in a single sports training system in accordance with the present invention.

When some or all of the elastic elements are slack, punching bag 101 does not necessarily have a single rest position. Instead, punching bag 101 can be at rest at any position within a predetermined region where the slack elastic elements are not tensioned. In the exemplary configuration of FIG. 21B, punching bag 101 can be at rest even if it is slightly moved towards the anchoring points 2184, 2185 of elastic elements 2194, 2195, provided that elastic elements 2191, 2192 will not be tensioned. The same is true if the elastic elements 2105 are all distributed to one side of the system. For example, if elastic elements 2195 is omitted from the system of FIG. 21B, punching bag 101 can be at rest at virtually any position adjacent beam 303A. In the simplest case, if only one elastic element 2195 is used, punching bag 101 can be at rest at any position within region R (phantom line in FIG. 21B) which is defined by the length of elastic element 2195. Thus, when punching bag 101 returns after being hit, it will not necessarily return to the same initial position can be settle at any, unpredictable point within a region where none of the elastic elements are tensioned. This is an advantage of the present invention over the conventional devices.

The elastic elements can be attached not only to the punching bag but also directly to the trolley truck, as shown at 1173 in FIG. 21B. In an alternative configuration (not shown), one or more elastic elements can be directly attached to moveable bar 604 to create different punching bag movements. The elastic elements are not necessarily attached to the corners of the frame as sown at anchoring points 2182 of elastic element 2192 in FIG. 21B. The elastic elements can even be attached to a location outside the system, e.g., the wall 2184 of the gym in which the system is installed. This flexibility allows the user to arrangement the elastic elements as he or she wishes.

Figures 22A, 22B, 22C:
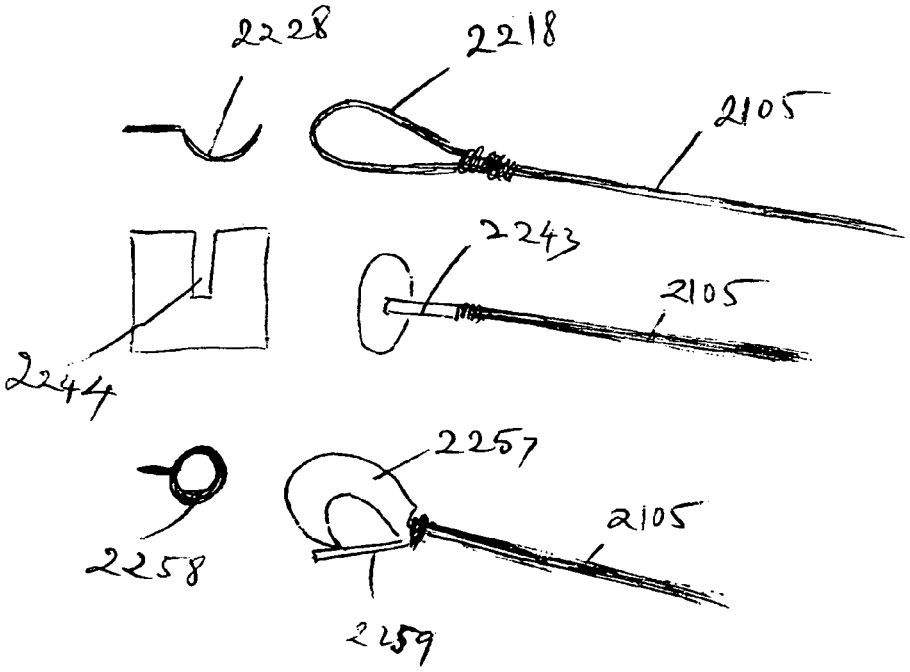
FIGS. 22A-22C are schematic views showing various attaching means that can be used in the sixth embodiment of the present invention.

The elastic elements can be attached to the supporting structure or frame of the inventive system or to a location outside the system by a number of ways illustrated in FIGS. 22A-22C. For example, a loop 2218 can be formed at the end of elastic element 2105 and to be engaged with a hook 2228 fixed to the frame of the system, as shown in FIG. 22A. The reverse configuration is also available as shown in FIG. 22C where a loop 2258 is provided to the system's frame, whereas elastic element 2105 has a matching hook 2257, which is preferably provided with a safety latch 2259. Another alternative arrangement includes an enlarged end 2243 of elastic element 2105 which is inserted into and retained by a slot 2244 on a beam of the system's frame.

Elastic elements such as 2105 can be used in any of the above described embodiments as well as other, alternative embodiments that are not described herein but nevertheless fall within the scope of the present invention.

The present invention affords a more complete workout with less impact to the user's wrists and joints, mostly because the punching bag is allowed greater moveability than in the conventional devices. The punching bag in the system of the present invention, moves with unpredictability to all points within the area, in random directions, angles, and patterns including linear, elliptical and circular. The punching bag in most cases will move toward the user and settle at a new different position from the initial position where it was hit. When the system is provided with elastic elements, the punching bag in most cases will move back to a rest region and settle therein at a new position other than the initial position where it was hit. The unpredictability of the punching bag movement and returned position provides a realistic fighting experience and dramatically improves the user's forward and lateral movement, and yet can be manipulated into specific movement as the user learns to master the system. The system, especially the elastic elements, can also be reconfigured with ease.

Skilled artisans would recognize numerous variations of the described preferred embodiments of the present invention. For example, although it has been disclosed that the components of the preferred embodiments are made of metal, any suitable material with sufficient strength can be used. The engagement between the element from which the punching bag is suspended, e.g., a trolley truck, and the moveable bar and the engagement between the moveable bar and the frame can be interchangeable. For example, the trolley truck can have a gear engagement with the moveable bar in a manner similar to the gear engagement between the moveable bar and the frame as described with respect to systems 100, 300 and 1300. The engagement between the trolley truck and the moveable bar and between the moveable bar and the frame can be of any type, as long as the trolley truck, and hence the punching bag, is moveable along the moveable bar and the moveable bar, in turn, is moveable along a path defined by the frame in response to the user's strikes. Therefore, the relative movements of the components are not limited to the above described modes, i.e., sliding, rolling or by gear. It is not excluded that sports training systems in accordance with the present invention may have more than two types of movement: the frame, e.g., 350, can be further placed on a track to be moveable therealong. The movement of the punching bag is not necessarily horizontal; it can be in any plane or, if more than two types of movement are used in the system, the punching bag can have three dimensional movements. In alternative configurations, the punching bag moving paths defined by the frame and/or the moveable bar and/or any additional track used in the system are not necessarily straight; the sides of the frames and/or the moveable bar and/or the additional track(s) can be curved or have any desired configurations.

Therefore, while there have been described and illustrated specific embodiments of the invention, it will be clear that variations in the details of the embodiments specifically illustrated and described may be made without departing from the true spirit and scope of the invention as defined in the appended claims.

What is claimed is:

1. A sports training system, comprising:

punching bag;

a supporting structure;

a first moving element supported by said supporting structure so as to be moveable relative to said supporting structure along a first path;

a second moving element supported by said first moving element so as to be moveable relative to said first moving element along a second path different from said first path; said second moving element comprising an attaching member for suspending the punching bag below said first moving element, thereby enabling the suspended punching bag to be moveable to any point within an area defined by said lirst and second paths;

wherein said supporting structure includes two spaced beams, and said first moving element includes a bar having opposite ends each being moveably supported by one of said beams of said supporting structure; wherein each of said beams includes a rack or a rail extending along a length of said beam to define said first path; and said bar includes at the opposite ends thereof gear wheels or grooved wheels engaged with and riding on the respective racks or rails;

wherein said bar is a shaft which rotates about an axis thereof while moving along said beams.

2. A sports training system, comprising:

a punching bag;

a supporting structure;

a first moving element supported by said supporting structure so as to be moveable relative to said supporting structure along a first path;

a second moving element supported by said first moving element so as to be moveable relative to said first moving element along a second path different from said first path; said second moving element comprising an attaching member for suspending the punching bag below said first moving element, thereby enabling the suspended punching bag weight to be moveable to any point within an area defined by said first and second paths;

wherein said supporting structure includes two spaced beams, and said first moving element includes a bar having opposite ends each being moveably supported by one of said beams of said supporting structure;

wherein said second moving element has an inverted U shape which is wrapped around said bar, lower ends of said inverted U shape being fixed together by an elongated fastener member which defines said attaching member for the suspended weight.

3. A sports training system, comprising:

a punching bag;

a supporting structure;

a first moving element supported by said supporting structure so as to he moveable relative to said supporting structure along a first path;

a second moving element supported by said first moving element so as to be moveable relative to said first moving element along a second path different from said first path; said second moving element comprising an attaching member for suspending the punching bag below said first moving element, thereby enabling the suspended punching bag weight to be moveable to any point within an area defined by said first and second paths;

wherein said supporting structure includes two spaced beams, and said first moving element includes a bar having opposite ends each being moveably supported by one of said beams of said supporting structure;

wherein said bar includes a longitudinal slot through which said attaching member of said second moving element extends, said second moving element further comprising a wheel riding on said bar and attached to an upper end of said attaching member.

4. The system of claim 3, wherein said attaching member of said second moving element includes at a lower end thereof an eye or hook for suspending the punching bag.

5. The system of claim 3, wherein the longitudinal slot of said bar has raised edges which define together a rail on which said wheel rides.

6. The system of claim 5, wherein each of said beams includes a rack extending along a length of said beam to define said first path; said first moving element further comprising gear wheels at the opposite ends of said bar and engaged with and riding on the respective racks.

7. The system of claim 6, wherein said first moving element further comprises a rod having opposite ends fixed to said gear wheels, whereby a rolling movement of said gear wheels on said racks causes said rod to rotate; and mounting brackets attached to the opposite ends of said bar and having holes through which said rod extends so as to rotatably support said rod above the longitudinal slot of said bar.

8. A sports training system, comprising: a punching bag; a supporting structure; a first moving element supported by said supporting structure so as to be moveable relative to said supporting structure along a first path; a second moving element supported by said first moving element so as to be moveable relative to said first moving element along a second path different from said first path; said second moving element comprising an attaching member for suspending the punching bag below said first moving element, thereby enabling the suspended punching bag to be moveable to any point within an area defined by said first and second paths; and a plurality of elastic elements having opposite end portions attached to said supporting structure and at least one of said first and second moving elements for returning said second moving element, and hence the suspended punching bag, to a predetermined region within said area after the suspended punching bag has been moved outside the predetermined region by a user; wherein at least two of the elastic elements have different values of at least one parameter selected from the group consisting of diameter, length, elasticity, maximum elongation, pretension, and compressive capability.

9. A sports training system, comprising:

a punching bag;

a supporting structure;

a first moving element supported by said supporting structure so as to be moveable relative to said supporting structure along a first path;

a second moving element supported by said first moving element so as to be moveable relative to said first moving element along a second path different from said first path; said second moving element comprising an attaching member for suspending the punching bag below said first moving element, thereby enabling the suspended punching bag to he moveable to any point within an area defined by said first and second paths;

wherein said supporting structure is a frame, said system further comprising said suspended punching bag and a plurality of elastic elements tying said suspended punching bag to a plurality of different locations on said frame, for returning said suspended punching bag weight, to a central region within said area after the suspended punching bag has been moved outside the central region by a user.

10. A method of installing a sports training system, comprising:

providing two spaced, parallel racks as a supporting structure;

positioning a first moving element on said supporting structure so that said first moving element is moveable relative to said supporting structure along a first path; said positioning comprising engaging two gear wheels at opposite ends of an elongated rod of the first moving element with the racks, respectively, so that the bar is rollable on said racks;

attaching a second moving element to said first moving element so that said second moving element is moveable relative to said first moving element along a second path different from said first path, said attaching comprising inserting a wheel of said second moving element into a hollow beam of said first moving element, which hollow beam rotatably supports the rod at an upper portion thereof and has an longitudinal slot with raised edges at a lower portion thereof, wherein said wheel of the second moving element has a groove to ride on said raised edges of the longitudinal slot upon said inserting; and suspending a punching bag below said first moving element by said second moving element, thereby enabling the punching bag to be moveable to any point within an area defined by said first and second paths when a user strikes said punching bag, said suspending comprising attaching an upper end of said punching bag to an attaching member of said second moving element which attaching member extends downwardly from said wheel of the second moving element through the longitudinal slot of said first moving element.

11. A sports training kit, comprising a punching bag suspension system and a plurality of elastic elements, said punching bag suspension system comprising: a supporting structure; a first moving element supported by said supporting structure so as to be moveable relative to said supporting structure along a first path; and a second moving element supported by said first moving element so as to be moveable relative to said first moving element along a second path different from said first path, said second moving element comprising an attaching member for suspending a punching bag below said first moving element, thereby enabling the punching bag to be moveable to any point within an area defined by said first and second paths; wherein said elongated, elastic element is adapted to be attached between said supporting structure and said second moving element or the punching bag for biasing the punching bag towards a region inside said area after the punching bag has been moved by a user outside the region.

wherein the plurality of said elastic elements are adapted to be attached between said second moving element or the punching bag and a plurality of different locations on said supporting structure.

* * * * *